US011142926B2

(12) United States Patent
Ervin

(10) Patent No.: US 11,142,926 B2
(45) Date of Patent: Oct. 12, 2021

(54) STORAGE CONTAINER

(71) Applicant: Dylan S. Ervin, Spokane, WA (US)

(72) Inventor: Dylan S. Ervin, Spokane, WA (US)

( * ) Notice: Subject to any disclaimer, the term of this patent is extended or adjusted under 35 U.S.C. 154(b) by 420 days.

(21) Appl. No.: 16/137,173

(22) Filed: Sep. 20, 2018

(65) Prior Publication Data

US 2019/0085595 A1 Mar. 21, 2019

Related U.S. Application Data

(60) Provisional application No. 62/560,951, filed on Sep. 20, 2017.

(51) Int. Cl.

| | |
|---|---|
| ***E05B 37/16*** | (2006.01) |
| ***E05G 1/04*** | (2006.01) |
| ***E05B 65/00*** | (2006.01) |
| ***F41C 33/06*** | (2006.01) |
| ***E05G 1/00*** | (2006.01) |
| ***F41B 5/14*** | (2006.01) |
| ***E05B 65/52*** | (2006.01) |

(52) U.S. Cl.

CPC ..... *E05B 37/16* (2013.01); *E05B 65/0075* (2013.01); *E05B 65/52* (2013.01); *E05G 1/005* (2013.01); *E05G 1/04* (2013.01); *F41B 5/1457* (2013.01); *F41C 33/06* (2013.01); *E05Y 2600/60* (2013.01); *E05Y 2900/602* (2013.01)

(58) Field of Classification Search

CPC ..... E05B 37/16; E05B 65/0075; E05B 65/52; E05B 47/02; E05G 1/005; E05G 1/04; E05G 1/00; E05G 1/06; E05G 1/026; F41B 5/1457; F41C 33/06; E05Y 2600/60; E05Y 2900/602

USPC .... 70/57, 57.1, 63, 158–169, 289, 290, 292; 109/59 R

See application file for complete search history.

(56) References Cited

U.S. PATENT DOCUMENTS

| | | | | |
|---|---|---|---|---|
| 596,185 | A * | 12/1897 | Smith | E05B 37/16 70/298 |
| 690,191 | A * | 12/1901 | Saxe | E05B 35/007 70/352 |
| 1,085,894 | A * | 2/1914 | Eagle | E05B 37/16 70/298 |

(Continued)

FOREIGN PATENT DOCUMENTS

| | | |
|---|---|---|
| CN | 201635567 | 11/2010 |
| CN | 103837039 | 6/2014 |
| GB | 2111580 | 7/1983 |

OTHER PUBLICATIONS

PCT Search Report and Written Opinion dated Dec. 27, 2018 for PCT Application No. PCT/US18/52043, 6 pages.

*Primary Examiner* — Suzanne D Barrett
(74) *Attorney, Agent, or Firm* — Lee & Hayes, P.C.

(57) ABSTRACT

A storage container including a lid, a base coupled to the lid, an interior cavity defined by a closed state of the lid and the base, and locking mechanism disposed in at least one of the lid or the base. The locking mechanism includes a first key that is actuatable in a first direction and one or more second keys that are actuatable in a second direction that is transverse to the first direction. The one or more second keys are configured to engage with the first key and when the one or more second keys are actuated in the second direction, the first key is actuatable in the first direction to unlock the locking mechanism.

19 Claims, 18 Drawing Sheets

(56) References Cited

U.S. PATENT DOCUMENTS

| | | | | | |
|---|---|---|---|---|---|
| 2,706,393 | A * | 4/1955 | Jamieson | E05B 37/163 | 70/315 |
| 2,822,683 | A * | 2/1958 | Kahn | E05B 37/16 | 70/288 |
| 3,433,185 | A | 3/1969 | Roberts | | |
| 3,514,981 | A * | 6/1970 | Esquibel | E05B 37/16 | 70/298 |
| 4,890,466 | A * | 1/1990 | Cislo | F41C 33/06 | 109/51 |
| 5,172,575 | A * | 12/1992 | Fisher | E05B 37/20 | 206/317 |
| 5,189,894 | A * | 3/1993 | Buck | E05B 37/16 | 292/DIG. 63 |
| 6,126,210 | A * | 10/2000 | Tom | E05B 17/2038 | 292/119 |
| 6,845,640 | B2 * | 1/2005 | Loeff | E05B 53/003 | 109/45 |
| 6,889,460 | B1 * | 5/2005 | Brauer | F41A 17/04 | 42/70.07 |
| 7,516,631 | B2 * | 4/2009 | Hacker | E05B 19/0005 | 109/51 |
| 8,186,188 | B1 * | 5/2012 | Brown | F41C 33/06 | 70/63 |
| 9,328,534 | B2 * | 5/2016 | Blankenship | E05B 65/0075 | |

* cited by examiner

STORAGE CONTAINER

CROSS REFERENCE TO RELATED APPLICATIONS

This application claims priority to U.S. Provisional Application 62/560,951, filed Sep. 20, 2017, the entirety of which is hereby incorporated by reference.

BACKGROUND

Valuable personal items that are portable, when not in regular use, are frequently stored for safekeeping within a safe or home vault. The items one stores vary widely from one individual to the next, including jewelry, currency, weapons, electronics, etc. Modern safes are often fireproof, heavy, relatively large, and sometimes fixed in place. To further enhance security, in many cases, a safe or home vault is kept out of sight and located in a remote area or less trafficked area of a residence to minimize visibility to potential intruders or burglars. Additionally, safes and home vaults generally require a key and/or entry of a security code to access the contents therein. Despite the general acceptance of the safekeeping aspects of a safe or home vault, in some instances, one may desire to temporarily maintain an item in a more convenient location when at home, work, or even on travel for quicker, easier, or more readily available access. Furthermore, regardless of the intrinsic value of an item, an individual may desire to maximize personal accessibility to the item while restricting easy access to the item to others, particularly to children who may not take proper care of the item.

As one example of items stored, firearms are often stored in gun safes to protect against theft, damage, and/or unauthorized use. Additionally, in some instances, firearms may be stored in a way that minimizes their risk of accidental harm. For instance, firearms may be kept in a closet, basement, and/or other locations not readily accessible. However, in times of emergency, storing firearms in gun safes and/or hard to reach places may limit their utility. For instance, there may be little time to locate a key and/or enter a security code to unlock a gun safe.

BRIEF DESCRIPTION OF THE DRAWINGS

The detailed description is set forth below with reference to the accompanying figures. In the figures, the left-most digit(s) of a reference number identifies the figure in which the reference number first appears. The use of the same reference number in different figures indicates similar or identical items. The systems depicted in the accompanying figures are not to scale and components within the figures and/or between different figures may be depicted not to scale with each other.

DETAILED DESCRIPTION

Figure 1:
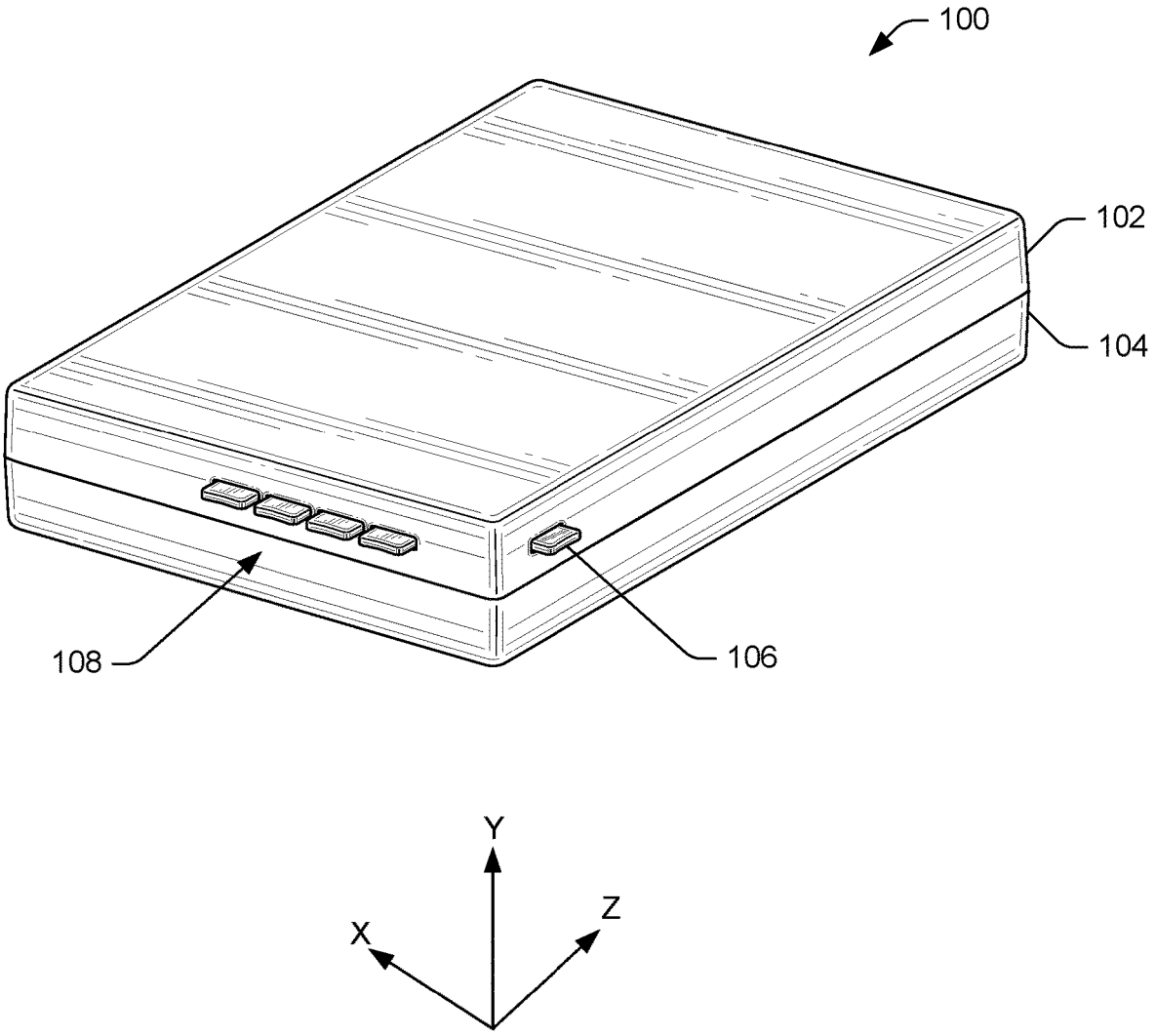
FIG. 1 illustrates a perspective view of a storage container according to an embodiment of this disclosure.

As discussed above, in emergency situations, conventional gun safes may prevent quick and easy access to firearms. For instance, it may be difficult and/or time consuming to obtain keys, enter security codes, and/or turn on lights to open a gun safe. Moreover, in instances where firearms are stored in non-easily accessible places, it may take significant time to retrieve the firearm. In these situations, because the firearm may not be quickly accessed, the utility of firearms may be significantly reduced. Furthermore, conventional gun safes are often heavy, bulky, and not easily transported. Some gun safes also fail to disguise or hide the contents contained therein, and in some settings, openly displaying a gun safe may be unappealing.

In light of the above, this disclosure describes a storage container that restricts access to one or more items contained therein, such as a firearm for example. Simultaneously, the storage container provides a capable and informed user the ability to access the stored item in a quick and efficient manner. In an embodiment, the storage container may include a lid and a base that define a housing of the storage container. The lid may hingedly couple to the base via one or more hinges and may be operable between an open and a closed position. In the open position, an interior cavity of the storage container is exposed, thereby permitting access to the stored items. In the closed position, the lid and the base enclose the interior cavity, creating a space that may be occupied by a stored item.

A locking mechanism restricts access to the interior cavity and items contained therein. The locking mechanism may include one or more locks that, when unlocked, provide access to the interior cavity of the storage container. The locks may be located at different locations to limit the lid and base from being manually plied apart.

In an embodiment, the locking mechanism may include a plurality of actuatable keys that, when actuated by a user in a correct combination and/or order, provide access to the interior cavity. Alternatively, when an incorrect order and/or combination of the keys is actuated, the locking mechanism restricts access to the interior cavity. The keys of the locking mechanism may represent buttons, latches, levers, or other elements that are capable of being actuated (e.g., push, pull, slide, etc.) by a user, for example via manual manipulation (e.g., predetermined action with a user's hand and fingers, etc.). Furthermore, the order and/or combination of keys used to unlock the storage container may be set by the user or may be preset by the manufacturer. For example, a user may select a combination of the first, second, and fifth keys as the correct combination of key(s) to be actuated to open the lid and access the interior cavity of the storage container. Moreover, while the actuation of the one or more keys may be accomplished via hand and finger movements by the user (see FIG. 20), it is contemplated that the concepts disclosed herein for unlocking the storage container may be adapted for other distinct manual actions to unlock the storage container.

Accordingly, the storage container discussed herein may minimize the need to locate separate insertable keys, input biometrics, and/or tediously enter an unlocking combination to access stored items. Instead, the storage container discussed herein may allow a capable and informed user to actuate the locking mechanism and unlock the storage container in a quick and efficient manner.

The storage container may be lightweight and easily transportable. The storage container may also have an opaque appearance to disguise contents contained therein. Further, the storage container may be aesthetically designed to blend within a plurality of environments, such as on a desk or a nightstand, for instance.

While the instant disclosure describes the use of the storage container for enclosing a firearm as an example of an item that may be stored therein, the storage container is not limited purely to the safe storage of firearms but may be used to secure a plurality of items. For instance, the storage container may be utilized to secure phones, wallets, important documents (e.g., passport), and/or keys (car, house, etc.), jewelry, miscellaneous electronic devices, etc. The discussion with regard to securing firearms illustrates just one example of how the storage container may be implemented.

Illustrative Embodiment of a Storage Device

FIG. 1 illustrates a perspective view of a storage container 100. In an embodiment, the storage container 100 may include a lid 102 that couples to a base 104. Together, the lid 102 and the base 104 may define a housing of the storage container 100. The lid 102 and the base 104 may snuggly fit together using minimal variance of dimensions between the sizes of the adjoining surfaces and/or seams of the lid 102 and the base 104. A snug fit may assist in preventing forced entry into the storage container 100, such as a screwdriver being wedged between the adjoining surfaces and/or seams.

The lid 102 and the base 104 may be hingedly coupled together via one or more hinges that permit the storage container 100 to transition between an open position and a closed position. For instance, FIG. 1 illustrates the storage container 100 in the closed position in which the lid 102, when aligned with the base 104, encloses an interior cavity of the storage container 100. Within the interior cavity, a space is created in which items, such as a firearm, may be stored. In the open position, the lid 102 is separated from the base 104 and the interior cavity is exposed to allow access to items stored therein.

Discussed herein below in greater detail, a locking mechanism limits access to the interior cavity of the storage container 100. The locking mechanism may include one or more actuatable keys that unlock the storage container 100. The keys may protrude through respective openings in the lid 102 and/or the base 104 to be actuatable by a user. For instance, FIG. 1 illustrates that the lid 102 may include openings through which a first key 106 and second keys 108 protrude. The first key 106 may be disposed through the lid 102 on a first side, while the second keys 108 may be disposed through the lid 102 on a second side. In an embodiment, the second keys 108 may be aligned along a straight line on the second side and may be evenly spaced apart from one another.

The first key 106 and the second keys 108 may be actuatable (e.g., pressed, pushed, rotated, etc.) to unlock the storage container 100 and provide access to the interior cavity of the storage container 100 when a correct combination of keys is actuated. In an embodiment, to unlock the storage container 100, the user may also apply a downward force on the lid 102 to open the storage container 100. Further, the first key 106 and/or each of the second keys 108 may be individually (e.g., independently) actuatable.

With reference to the Cartesian (X-Y-Z) coordinate system in FIG. 1, the first key 106 may be actuated in the X-direction, while the second keys 108 may be actuated in the Z-direction. Upon entering the correct combination, the one or more locking points may unlock and the storage container 100 may open in the Y-direction and about the Z-axis (via the one or more hinges).

As discussed in detail herein, the second keys 108 may include multiple types/kinds of keys. In addition to possibly being different shapes or sizes than those depicted, some of the second keys 108 restrict access to the interior cavity while some of the second keys 108 provide access to the interior cavity. In other words, actuating the second keys 108 that provide access to the interior cavity may unlock the locking mechanism. However, if at least one of the second keys 108 that limit access to the interior cavity are actuated, in addition to or in lieu of the second keys 108 that provide access to the interior cavity, the locking mechanism is configured to remain locked.

In an embodiment, the lid 102 and/or the base 104 may further include one or more holes through which a tether (e.g., chain, link, rope, etc.) may extend to lock and/or secure the storage container 100. In an embodiment, the tether may prevent the storage container 100 from unauthorized transport. For example, the tether may be secured to locks, structures (e.g., legs of furniture), posts, etc.

Although FIG. 1 illustrates a single first key 106 (e.g., one) and multiple second keys 108 (e.g., four), the storage container 100 and/or the locking mechanism may be implemented with fewer or additional first and/or second keys. Additionally, FIG. 1 illustrates that the storage container 100 may be rectangular-shaped, however, it is contemplated and one skilled in the art would readily appreciate that the storage container 100 may be shaped differently. For instance, the storage container 100 may be hexagonal, square, cylindrical, etc. The storage container 100 may also be sized and/or scaled to accommodate a range of items that may be stored (e.g., rifles, pistols, bow and arrows, etc.).

The storage container 100 may be manufactured from a plurality of materials, including but not limited to plastics, metals, composites, or any combination thereof. The materials from which the storage container 100 is manufactured may be strong, durable, resilient, impact-proof, and withstand forced entry. The storage container 100 may also be fireproof and/or waterproof. For example, seals and/or other barriers (not shown) may also be included to waterproof the interior cavity of the storage container 100.

Figure 2B:
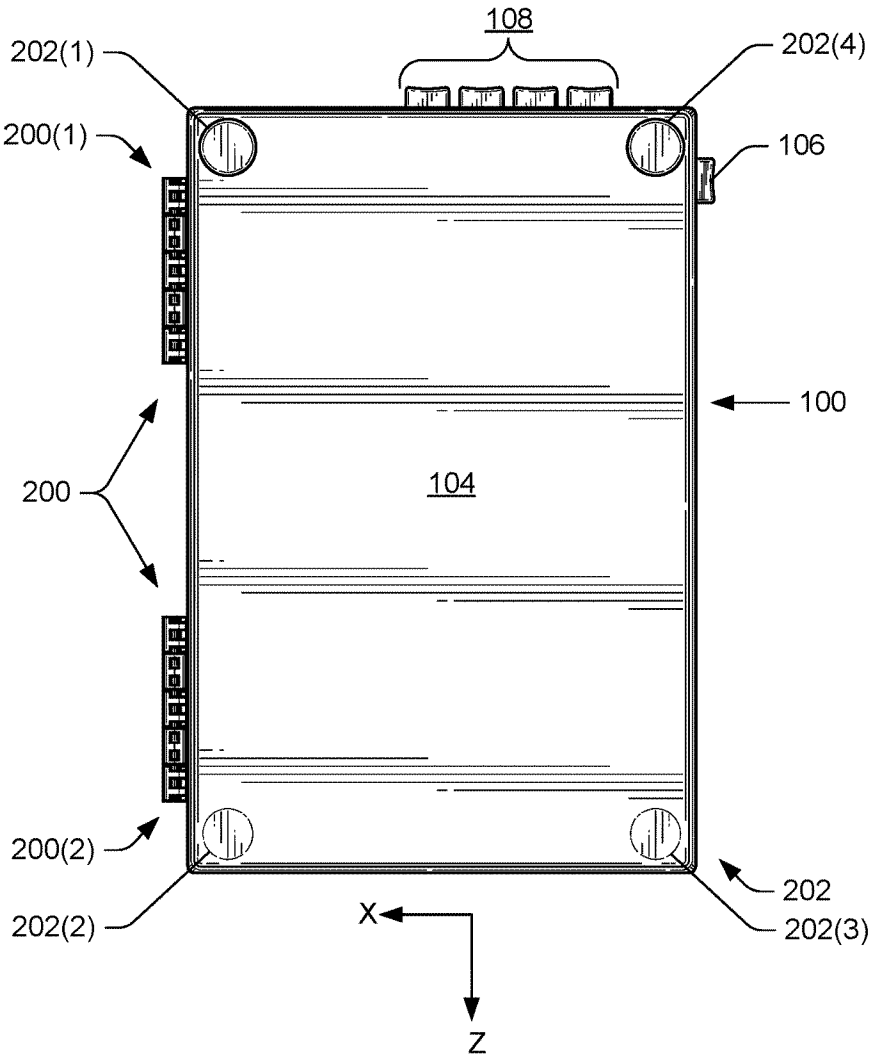
FIG. 2B illustrates a bottom view of the storage container of FIG. 1 according to an embodiment in this disclosure.
Figure 2A:
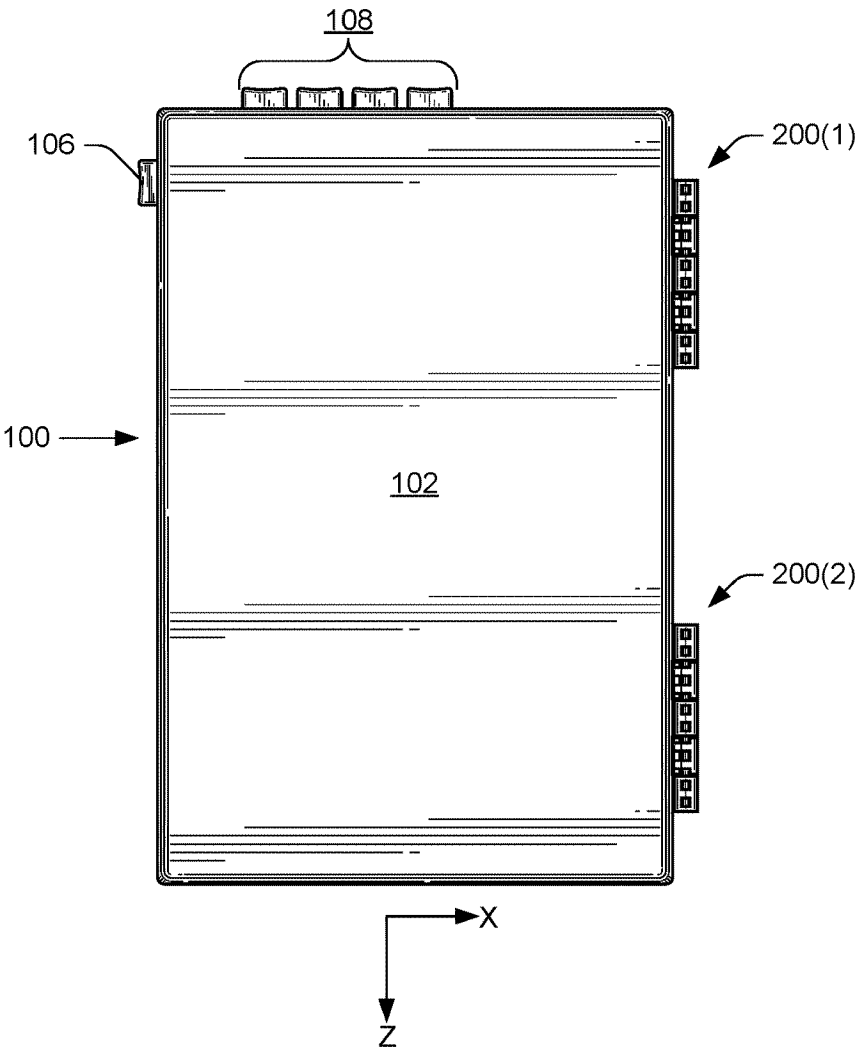
FIG. 2A illustrates a top view of the storage container of FIG. 1 according to an embodiment in this disclosure.

FIGS. 2A and 2B illustrate a top view of the storage container 100 and a bottom view of the storage container 100, respectively. As illustrated in FIGS. 2A and 2B, the first key 106 and the second keys 108 may protrude beyond a perimeter or exterior of the housing defined by the lid 102 and the base 104 of the storage container 100, thereby allowing the first key 106 and the second keys 106 to be actuatable. The first key 106 and the second keys 108 may be located on sides or surfaces of the storage container 100 different than those depicted.

The lid 102 and the base 104 may couple together through one or more hinges 200(1) and 200(2) (collectively, "hinges 200"). The hinges 200 may provide rotational movement of the lid 102 and/or the base 104 between the open position and the closed position of the storage container 100.

As shown in FIG. 2B, the base 104 may include one or more pads 202(1), 202(2), 202(3), and 202(4) (collectively, "pads 202"). The pads 202 may be manufactured of anti-slip materials, such as rubber and/or silicone, to secure the storage container 100 on surfaces and/or prevent the storage container 100 from sliding off surfaces, such as a nightstand, countertop, and so forth. The base 104, as depicted, may include four pads 202. However, it is contemplated that the base 104 may include fewer or more pads 202, which may be similarly or differently shaped, sized, and located than those illustrated in FIG. 2B.

Figure 3A:
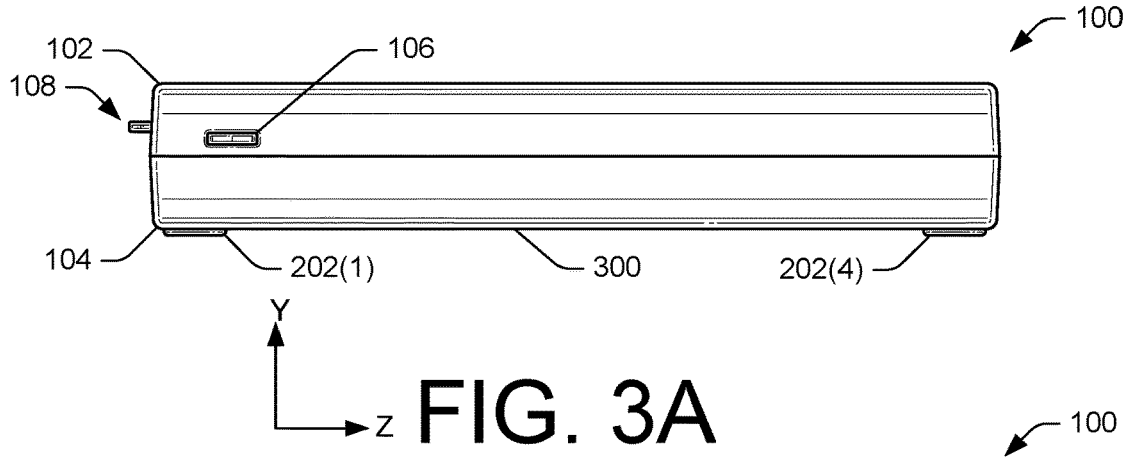
FIG. 3A illustrates a first side view of the storage container of FIG. 1 according to an embodiment in this disclosure.
Figure 3B:
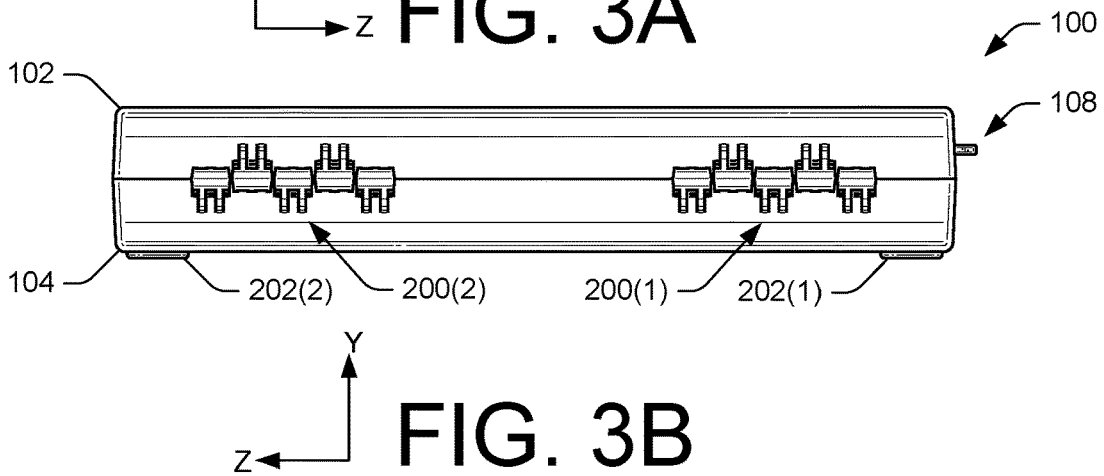
FIG. 3B illustrates a second side view of the storage container of FIG. 1 according to an embodiment in this disclosure.

FIGS. 3A and 3B illustrate a first side view and a second side view of the storage container 100, respectively. Shown in FIG. 3A, the second keys 108 may protrude from the lid 102 and extend beyond an exterior surface of the storage container 100. As depicted, the first key 106 may be disposed along a first X-Z plane spaced apart in the Y-direction from a second X-Z plane along which the second keys 108 are disposed. Alternatively, the first key 106 and the second keys 108 may be co-planar (not shown).

The pads 202 may offset a bottom surface 300 of the base 104 such that base 104 rests above a surface on which storage container 100 is placed (e.g., counter).

Shown in FIG. 3B, the hinges 200 may couple the lid 102 and the base 104, thereby forming the storage container 100. A first portion of the hinges 200 may be disposed or otherwise integrated with the lid 102 and a second portion of the hinges 200 may be disposed or otherwise integrated with the base 104. After the first portion and the second portion are aligned, a rod or pin may be placed through the hinges 200 to couple the lid 102 and the base 104 together. In an embodiment, the hinges 200 or other features of the hinges 200 may be overmolded around the pin to prevent the pin being removed, thereby limiting forced entry into the storage container 100 or a deconstruction of the storage container 100.

Figure 4A:
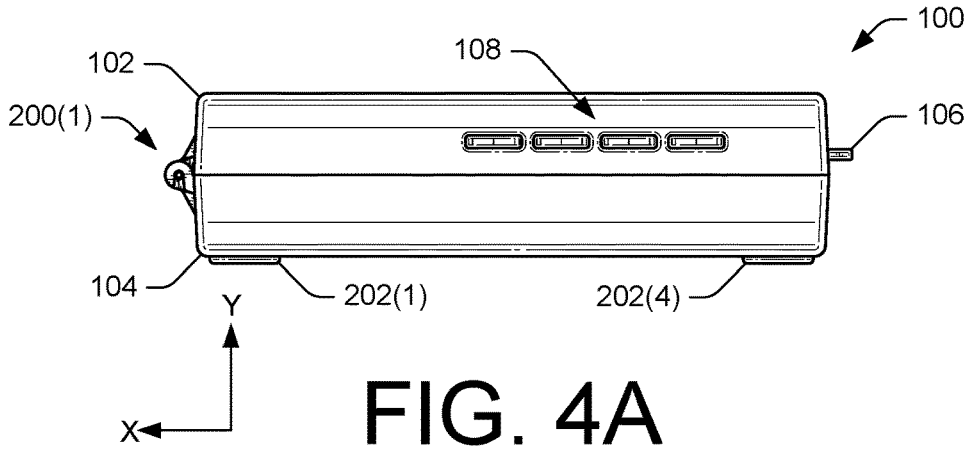
FIG. 4A illustrates a third side view of the storage container of FIG. 1 according to an embodiment in this disclosure.
Figure 4B:
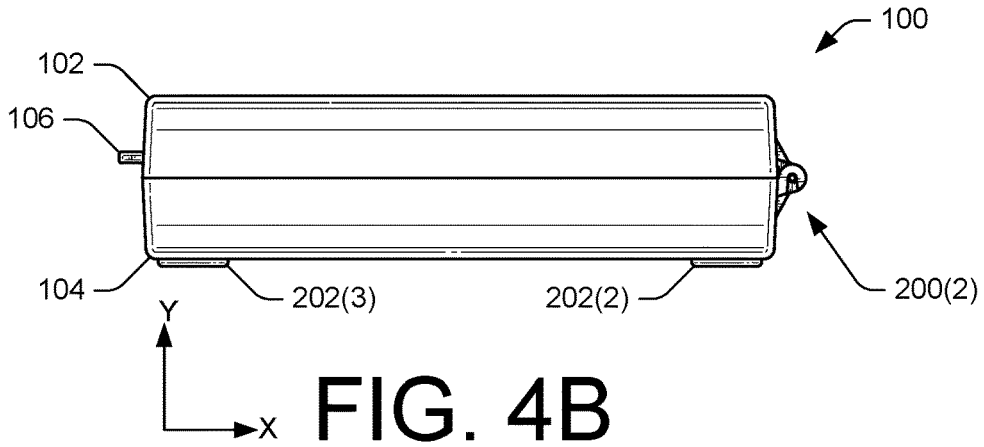
FIG. 4B illustrates a fourth side view of the storage container of FIG. 1 according to an embodiment in this disclosure.

FIGS. 4A and 4B illustrate a third side view and a fourth side view of the storage container 100, respectively. Shown in FIGS. 4A and 4B, the hinges 200 permit the lid 102 to open in the Y-direction, rotating about the hinges 200. FIG. 4A further illustrates that, as stated above, the first key 106 and the second keys 108 may be disposed along distinct X-Z planes spaced apart in the Y-direction.

Figure 5:
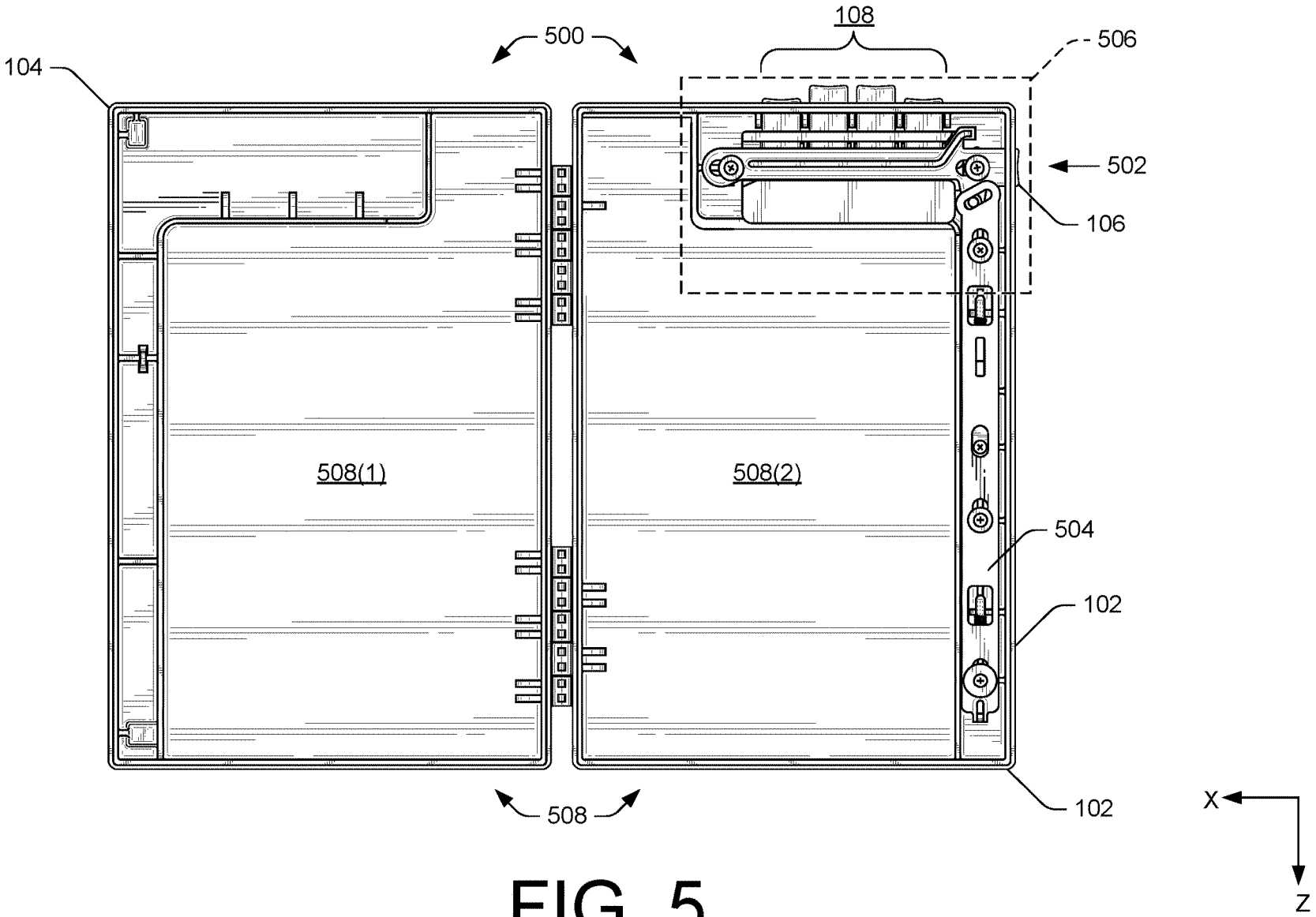
FIG. 5 illustrates a plane view of the interior cavity of the storage container when opened, according to an embodiment in this disclosure.

FIG. 5 illustrates a plan view of the storage container 100 in an open position, showing an interior cavity 500. As illustrated, the lid 102 and the base 104 may define halves or portions of the storage container 100 that open about the hinges 200 and expose the interior cavity 500.

As briefly discussed above, the interior cavity 500 may be accessed via entering a combination on a locking mechanism 502. FIG. 5 illustrates an example of a predetermined correct combination of keys being actuated, thereby providing access to the interior cavity 500. As such, a portion of the second keys 108 are shown in an actuated state (i.e., partially depressed through the wall of the lid 102 into the interior cavity 500 and in a biased, tensioned state), while another portion of the second keys 108 are shown in a resting state (i.e., not depressed and in a relaxed state fully extended through the wall of the lid 102).

In an embodiment, the locking mechanism 502 may include the first key 106, the second keys 108, and a slide 504 that operably couples to the first key 106. In an embodiment, the locking mechanism 502 may include multiple locking points that unlock when the correct combination of keys is actuated. For example, discussed in greater detail herein, when the correct combination of keys is actuated, the first key 106 may unlock a first locking point through advancing in the X-direction and the slide 504 may unlock a second locking point through advancing in the Z-direction.

The locking mechanism 502 may be unlocked through a user pressing the first key 106 and one or more of the second keys 108 with his or her hand(s). In other words the locking mechanism 502 may be configured such that when a predetermined combination of keys is pressed (e.g., second keys 108), the storage container 100 unlocks. A further discussion of the locking mechanism 502 is discussed with reference to the detailed view 506 shown in FIG. 6.

In an embodiment, the locking mechanism 502 may be located on a corner of the storage container 100 to allow a user to easily position his or her right hand on the storage container 100 and actuate the first key 106 and the second keys 108. Though the drawings in the instant disclosure depict right-handed opening, it is contemplated and understood by those skilled in the art that by modifying the position of the keys and the locking mechanism to be positioned on the adjacent corner of the storage mechanism, the storage container would be openable using a left hand. Regardless of whether a storage container is configured for right-hand use or left-hand use, the locking mechanism 502 may couple to the lid 102 of the storage container 100 through attachment means including one or more of screws, adhesion, snap-fit, etc.

The interior cavity 500 may include a first foam insert 508(1) disposed on the base 104 and/or a second foam insert 508(2) disposed on the lid 102 (collectively, "foam 508"). The foam 508 may line portions of the interior cavity 500 and may assist in securing items stored within the interior cavity 500, such as a firearm. Further, the foam 508 may protect the stored item from being damaged by shifting within the interior cavity 500.

Additionally, and/or alternatively, in an embodiment, the interior cavity 500 may include support racks or other features (not shown) to hold items in place (e.g., firearms in a ready position for easily grasping and immediate use). The support racks may extend from either one or both of the base or the lid 102. The interior cavity 500 (or portions of the exterior surface of the storage container 100) may also include one or more magnets (not shown) that permit the storage container 100 to be mounted to corresponding magnetic surfaces on a surface, such as an underneath side of a shelf or a nightstand.

Figure 6:
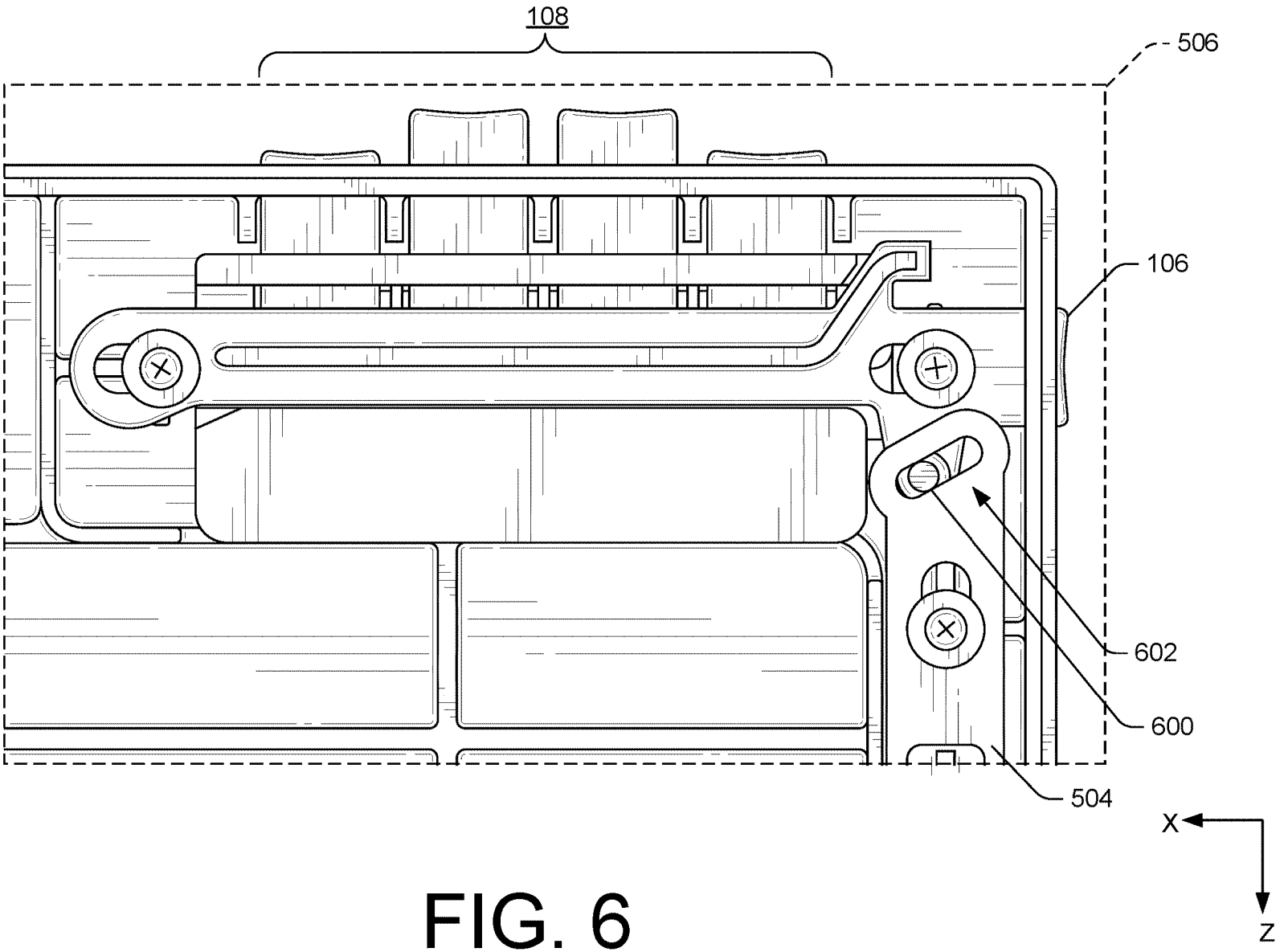
FIG. 6 illustrates a plane sectional view of a portion of a locking mechanism of the storage container according to an embodiment in this disclosure.

FIG. 6 illustrates a plane sectional detailed view 506 of a portion of the locking mechanism 502. Additionally, the detailed view 506 illustrates the locking mechanism 502 in an unlocked state, showing the first key 106 actuated (e.g., depressed in the X direction) and some of the second keys 108 actuated (e.g., depressed in the Z-direction). Certain second keys 108 are shown not depressed, representing those second keys 108 not required be actuated to unlock the storage container 100.

In an embodiment, the first key 106 may represent a master key actuated by a thumb of the user, and the second keys 108 may engage, attach, or otherwise couple to the first key 106 via extrusions on the first key 106. The second keys 108 may include corresponding channels that couple respective second keys 108 to the first key 106, align the second keys 108 with the first key 106, allow certain keys of the second keys 108 to be actuatable, and/or retain the second keys 108 within the locking mechanism 502.

The slide 504 may engage with the first key 106 via a protrusion 600 on the first key 106 located within a slot 602 of the slide 504. The protrusion 600 may move (e.g., slide) within the slot 602 such that when the first key 106 is actuated in the X-direction, the slide 504 advances in the Z-direction to unlock one or more locking points.

FIG. 6 further illustrates that the first key 106 may extend substantially perpendicularly to a direction of extension of the second keys 108 and/or the slide 504. Additionally, the second keys 108 may be aligned in a straight line and evenly spaced apart from one another. Alternatively, the second keys may be offset slightly from each other in the Y-direction to accommodate a difference in length of extension of a user's fingertips.

Figure 7A:
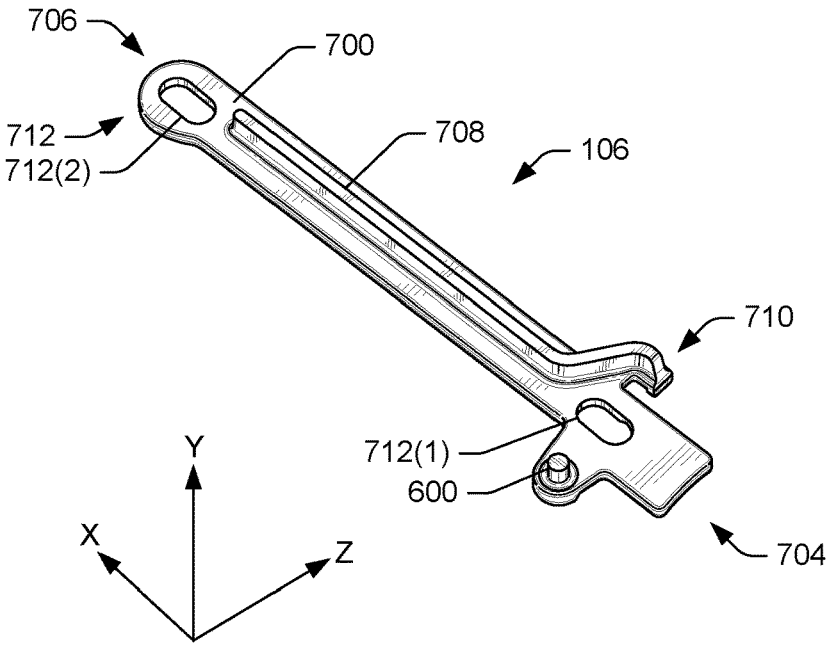
FIG. 7A illustrates a perspective view of a first side of a first key of the locking mechanism according to an embodiment in this disclosure.
Figure 7B:
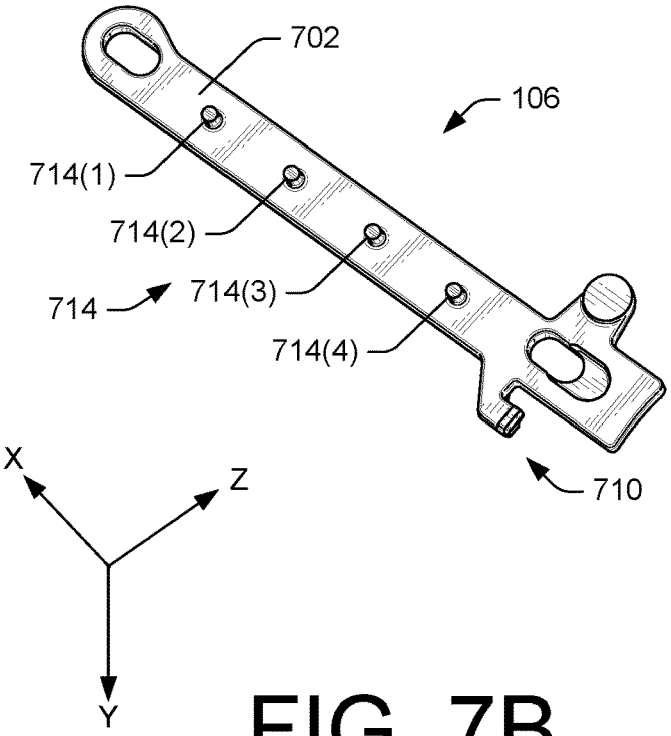
FIG. 7B illustrates a perspective view of a second side of the first key of FIG. 7A according to an embodiment in this disclosure.

FIGS. 7A and 7B illustrate a perspective view of a first side and a perspective view of a second side of the first key 106, respectively. For reference purposes in the description, the first key 106 includes a top surface 700, a bottom surface 702, a first end 704, and a second end 706. The first end 704 may include a protrusion shaped to protrude through the wall of the lid 102 of the storage container 100 and is actuatable by the user. In an embodiment, the protrusion on the first end 704 may include a depression and/or other concave features shaped to receive a finger of the user.

In an embodiment, the top surface 700 may include a ridge 708 that provides structural support in the form of longitudinal rigidity to the first key 106. For example, when the first key 106 is actuated, the ridge 704 may prevent the first key 106 from deflecting in the Y-direction. The ridge 708 may include a first attachment mechanism 710 having one or more features (e.g., latch, catch, flange, lip, protrusion, etc.) that engage with a corresponding attachment mechanism on the base 104 of the storage container 100 in the closed position. The first attachment mechanism 710 may be located proximal to the first end 704 of the first key 106. The engagement between the first attachment mechanism 710 and the corresponding attachment mechanism on the base 104 may represent a first locking point of the locking mechanism 502. In an embodiment, the engagement between the first attachment mechanism 710 and the base 104 may prevent an unauthorized user from pulling apart or prying apart portions of the storage container 100.

The first key 106 may also include a first slot 712(1) and a second slot 712(2) (collectively, "slots 712") that allow the first key 106 to slide within the locking mechanism 502. To secure the first key 106 within the locking mechanism 502, screws or other fasteners may extend through the slots 712. The screws may be sized smaller than the slots 712 to allow the first key 106 to actuate in the X-direction (i.e., maneuvering around the screws). The screws coupling the first key 106 to the locking mechanism 502 may also align the first key 106 to move the first key 106 in the X-direction.

The protrusion 600 that engages with the slot 602 of the slide 504 may extend from the top surface 700 of the first key 106, as shown. However, in an alternative embodiment (not shown), the protrusion 600 may extend from the bottom surface 702.

With reference to FIG. 7B, the bottom surface 702 may include a first protrusion 714(1), a second protrusion 714(2), a third protrusion 714(3), and a forth protrusion 714(4) (collectively, "protrusions 714"). The protrusions 714 may be spaced along a lengthwise direction of the first key 106(X-direction) between the first end 704 and the second end 706. The protrusions 714 are configured to engage with corresponding channels on respective keys of the second keys 108, thereby operably coupling the first key 106 and the second keys 108. In an embodiment, the protrusions 714 may be cylindrically-shaped which may assist the protrusions 714 to easily slide within the channels of the second keys 108.

Figure 8:
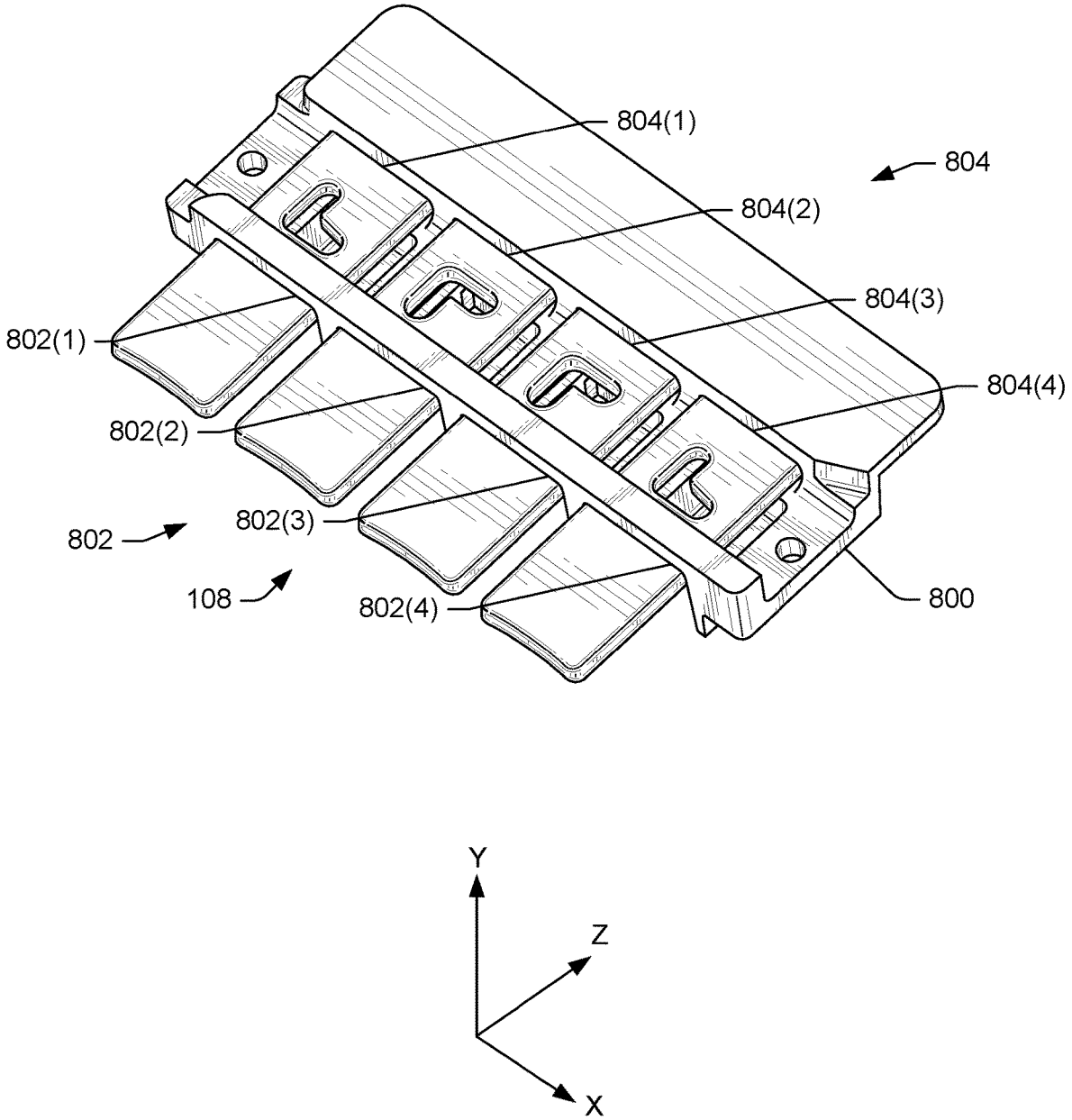
FIG. 8 illustrates a perspective view of the carriage with the second keys of the locking mechanism inserted, according to an embodiment in this disclosure.

FIG. 8 illustrates a perspective view of a carriage 800 of the locking mechanism 502 and the second keys 108 inserted therein. FIG. 8 also illustrates the second keys 108 in the resting state (discussed above), extending in the Z-direction.

The second keys 108 may be disposed within carriage 800 of the locking mechanism 502. The carriage 800 may include a first receiver 802(1), a second receiver 802(2), a third receiver 802(3), and a fourth receiver 802(4) (collectively, "receivers 802") to receive a respective key of the second keys 108. Additionally, the carriage 800 may include a first passageway 804(1), a second passageway 804(2), a third passageway 804(3), and a fourth passageway 804(4) (collectively, "passageways 804") through which a respective second key 108 may extend. That is, when actuated, the second keys 108 may extend through a respective passageway of the passageways 804 to permit the second key 108 to advance in the Z-direction.

FIG. 8 further illustrates that the second keys 108 may include different keys and/or keys having different features. As discussed in detail herein, the second keys 108 may include differently shaped or orientated channels that receive respective protrusions of the protrusions 714. By using different combinations of varying second keys 108 and/or swapping the order in which the second keys 108 are placed in the carriage 800, those second keys 108 that unlock the locking mechanism 502 may be interchanged as desired by the user. As such, the second keys 108 may be configurable so as to selectively form a combination to unlock the locking mechanism 502.

In an embodiment, the receivers 802 and/or the passageways 804 may align the second keys 108 within the carriage 800 such that the second keys 108, when actuated, track in the Z-direction. The receivers 802 and/or the passageways 804 may also align the second keys 108 with the first key 106 such that the protrusions 714 engage with a key of the second keys 108.

Figure 9A:
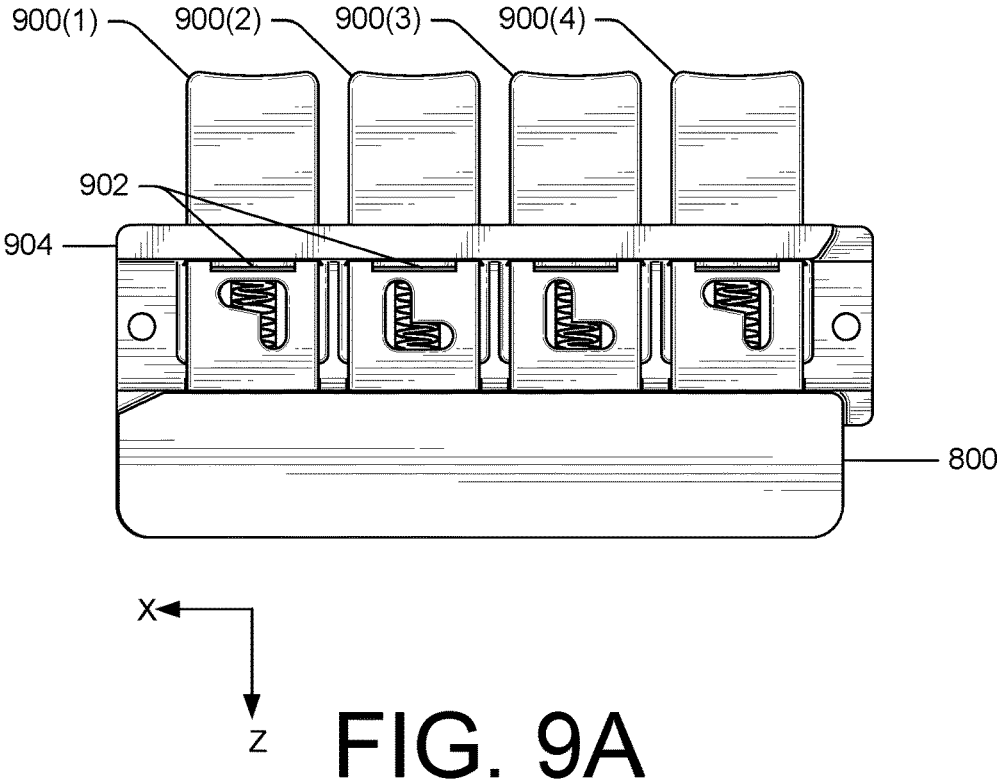
FIG. 9A illustrates a plane view of the first side of the carriage with the second keys of the locking mechanism inserted.

FIG. 9A illustrates a plane view of a first side of the carriage 800 of the locking mechanism 502 to assist in illustrating additional aspects of the second keys 108 with respect to the carriage 800. In an embodiment, the second keys 108 may include unlocking keys and locking keys. Unlocking keys are a version of second keys 108 that inhibit access to the interior cavity 500 of the storage container 100 unless and until they are actuated, at which point, the inhibiting feature configured in the unlocking key is shifted to a different position, thereby making access a possibility—provided that a correct combination of unlocking keys are actuated also. In contrast, locking keys are a version of second keys 108 that do not inhibit access to the interior cavity 500 of the storage container 100 when they are in the resting position. However, when a locking key is actuated, the locking key prevents the storage container 100 from unlocking.

In an embodiment, the second keys 108 may include four keys, which may include a mixture of unlocking keys and locking keys. The second keys 108 may include a first key 900(1), a second key 900(2), a third key 900(3), and a fourth key 900(4) residing within the carriage 800. In the embodiment depicted, the first key 900(1) and the fourth key 900(4) are unlocking keys, and the second key 900(2) and the third key 900(3) are locking keys. Each of the second keys 108 may include a channel to receive a respective protrusion of the protrusions 714. Further, each of the second keys 108 may include a rib 902 to assist in retaining each of the second keys 108 in place in the carriage 800. The ribs 902 may extend from a top surface of the second keys 108 to prevent the second keys 108 from disengaging with the carriage 800. Each of the ribs 902 may abut a bar 904 of the carriage 800 to hold the second keys 108 within the carriage 800.

Figure 9B:
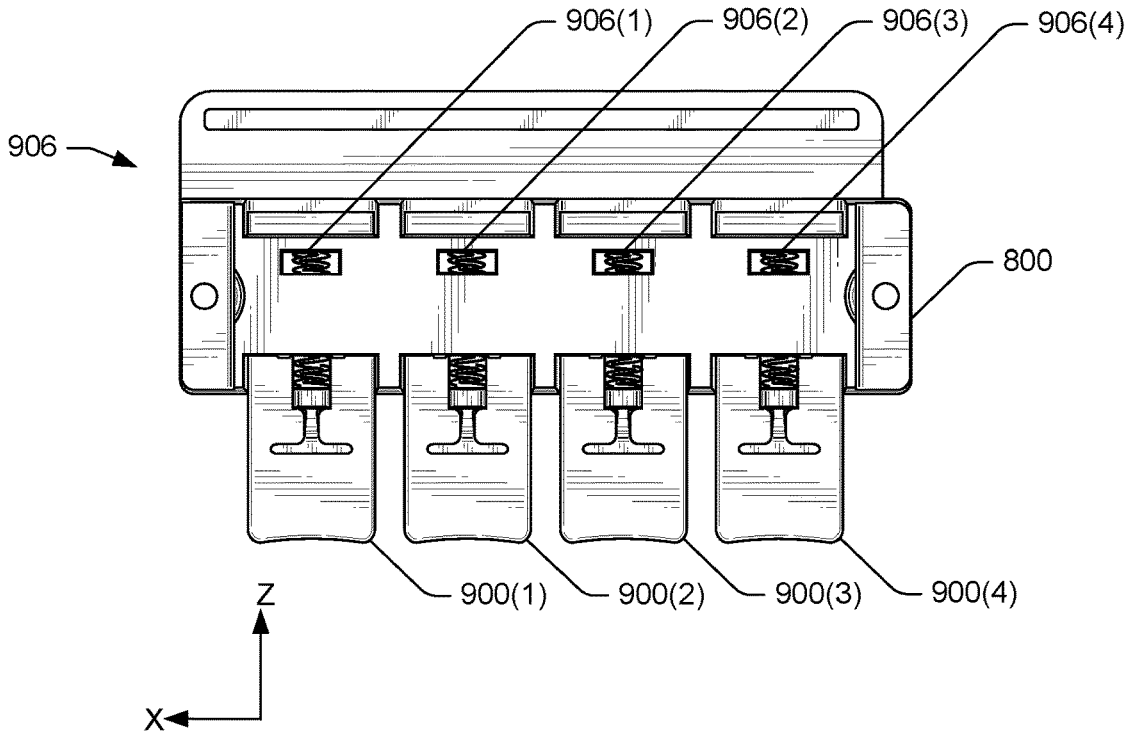
FIG. 9B illustrates a plane view of the second side of the carriage with the second keys of the locking mechanism inserted according to an embodiment in this disclosure.
Figure 10A:
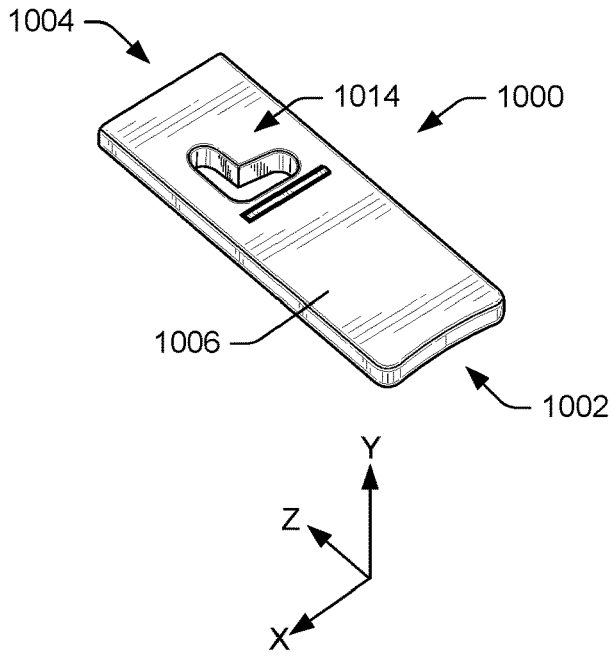
FIG. 10A illustrates a perspective view of a first side of a locking second key of the locking mechanism according to an embodiment in this disclosure.
Figure 10B:
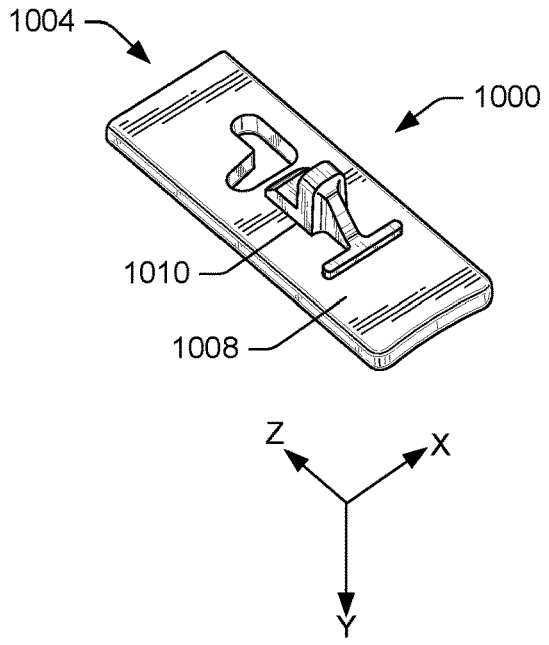
FIG. 10B illustrates a perspective view of a second side of the locking second key of FIG. 10A according to an embodiment in this disclosure.
Figure 10C:
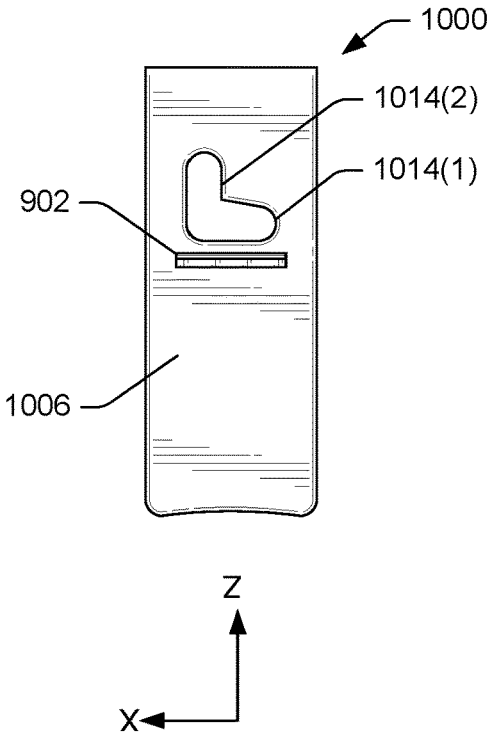
FIG. 10C illustrates a plane view of the first side of the locking second key according to an embodiment in this disclosure.
Figure 10D:
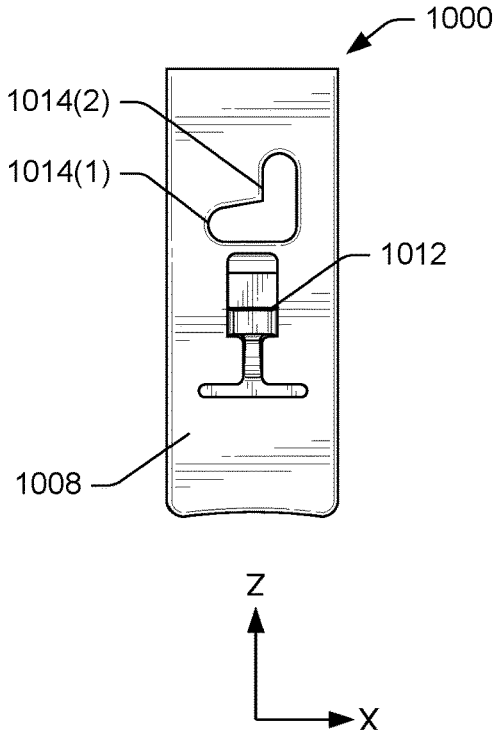
FIG. 10D illustrates a plane view of the second side of the locking second key according to an embodiment in this disclosure.
Figure 11A:
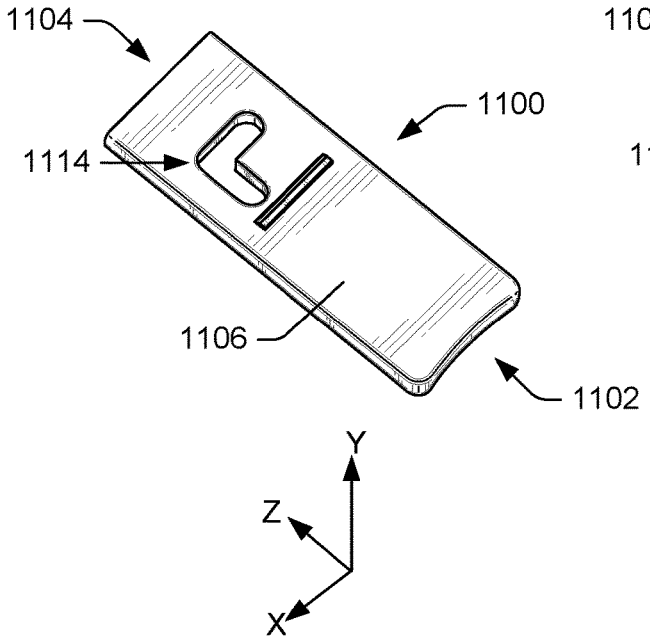
FIG. 11A illustrates a perspective view of a first side of an unlocking second key of the locking mechanism according to an embodiment in this disclosure.
Figure 11B:
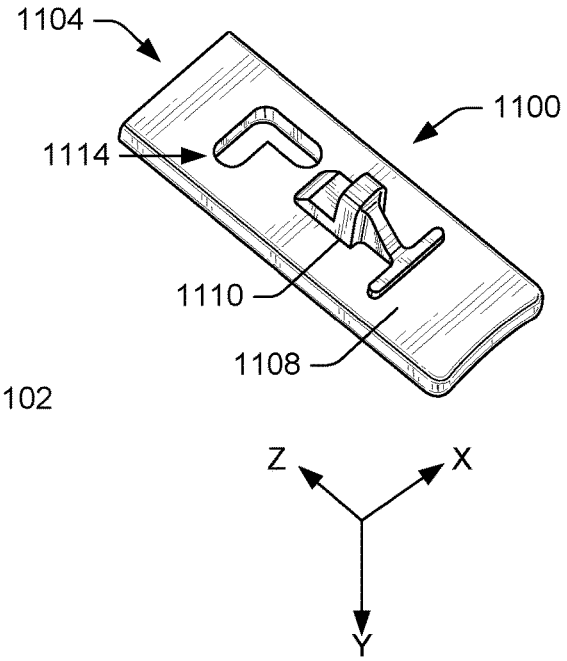
FIG. 11B illustrates a perspective view of a second side of the unlocking second key of FIG. 11A according to an embodiment in this disclosure.
Figure 11C:
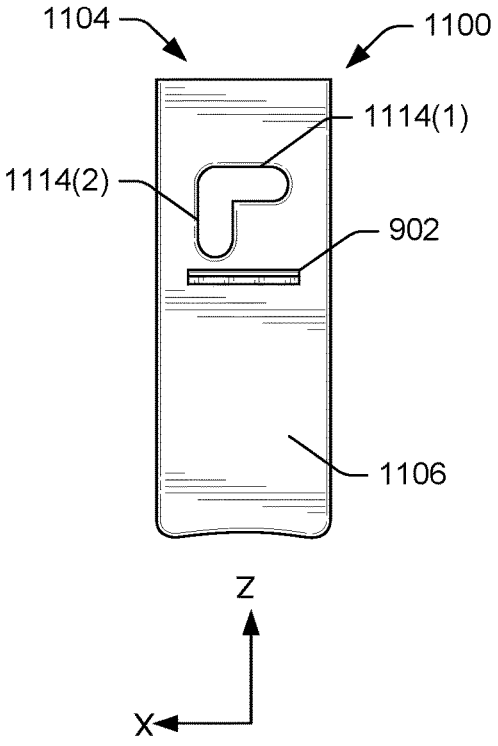
FIG. 11C illustrates a plane view of the first side of the unlocking second key according to an embodiment in this disclosure.
Figure 11D:
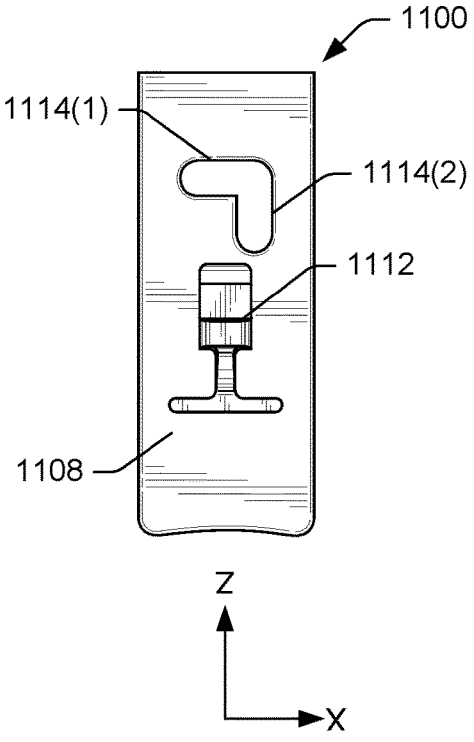
FIG. 11D illustrates a bottom view of the second side of the unlocking second key according to an embodiment in this disclosure.

FIG. 9B illustrates a plane view of a second side of the carriage 800 and the second keys 108, showing that each of the second keys 108 may be in communication with a spring to maintain a resting position of the second keys 108. For example, the first key 900(1) may engage with a first spring 906(1), the second key 900(2) may engage with a second spring 906(2), the third key 900(3) may engage with a third spring 906(3), and the fourth key 900(4) may engage with a fourth spring 906(4) (collectively, "springs 906"). The springs 906 abut respective blocking surfaces (see spring holder 1010 of FIG. 10B for example) of the second keys 108 and respective blocking surfaces of the carriage 800 to maintain the resting position of the second keys 108. As shown, when released from an actuated position, the associated springs 906 cause the second keys 108 to extend back to their respective resting positions.

FIGS. 10A, 10B, 10C, and 10D illustrate various views of an unlocking key 1000 (e.g., the first key 900(1) and/or the fourth key 900(4) of the second keys 108). The unlocking key 1000 includes a first end 1002 and a second end 1004. The first end 1002 may include a concave feature (e.g., indentation, depression, concavity, etc.) to receive a finger of a user. The second end 1004 may be sized to extend through a respective passageway 804 of the carriage 800, such that unlocking key 1000 may be actuated in the Z-direction.

A top surface 1006 of the unlocking key 1000 may include the rib 902. The bottom surface 1008 of the unlocking key 1000 may include a spring holder 1010. The spring holder 1010 is configured to receive one of the springs 906. Further, as indicated above, surface 1012 of the spring holder 1010 is configured to have a spring compress against the surface 1012.

The unlocking key 1000 may include a channel 1014. The channel 1014 may be sized to receive a respective protrusion of the protrusions 714. In an embodiment, the channel 1014 may be L-shaped. In an embodiment, the channel 1014 may include a first portion 1014(1) and a second portion 1014(2). The first portion 1014(1) may extend in the X-direction and have a thickness in the Z-direction. The second portion 1014(2) may extend in the Z-direction and have a thickness in the X-direction. The first portion 1014(1) and the second portion 1014(2) may adjoin so as to form the channel 1014. In an embodiment, the channel 1014 may include a slope or chamfer extending from a point at which the first portion 1014(1) and the second portion 1014(2) adjoin to an end of the first portion 1014(1) in the X-direction.

FIGS. 11A, 11B, 11C, and 11D illustrate various views of a locking key 1100 (e.g., the second key 900(2) and the third key 900(3) of the second keys 108). The locking key 1100 includes a first end 1102 and a second end 1104. The first end 1102 may include a concave feature (e.g., indentation, depression, concavity, etc.) to receive a finger of a user. The second end 1104 may be sized to extend through a respective passageway 804 of the carriage 800 such that locking key 1100 may be actuated in the Z-direction.

A top surface 1106 of the locking key 1100 may include the rib 902. The bottom surface 1108 of the locking key 1100 may include a spring holder 1110 (which may be similar to and/or different than the spring holder 1010 of the unlocking key 1000). The spring holder 1110 is configured to receive one of the springs 906. The surface 1112 of the spring holder 1110 is configured to have a spring to compress against the surface 1112.

The locking key 1100 may include a channel 1114. The channel 1114 may be sized to receive a respective protrusion of the protrusions 714 and in an embodiment may be L-shaped. In an embodiment, the channel 114 may include a first portion 1114(1) and a second portion 1114(2). The first portion 1114(1) may extend in the X-direction and have a thickness in the Z-direction. The second portion 1114(2) may extend in the Z-direction and have a thickness in the X-direction. The first portion 1114(1) and the second portion 1114(2) may adjoin so as to form the channel 1114.

Figure 12A:
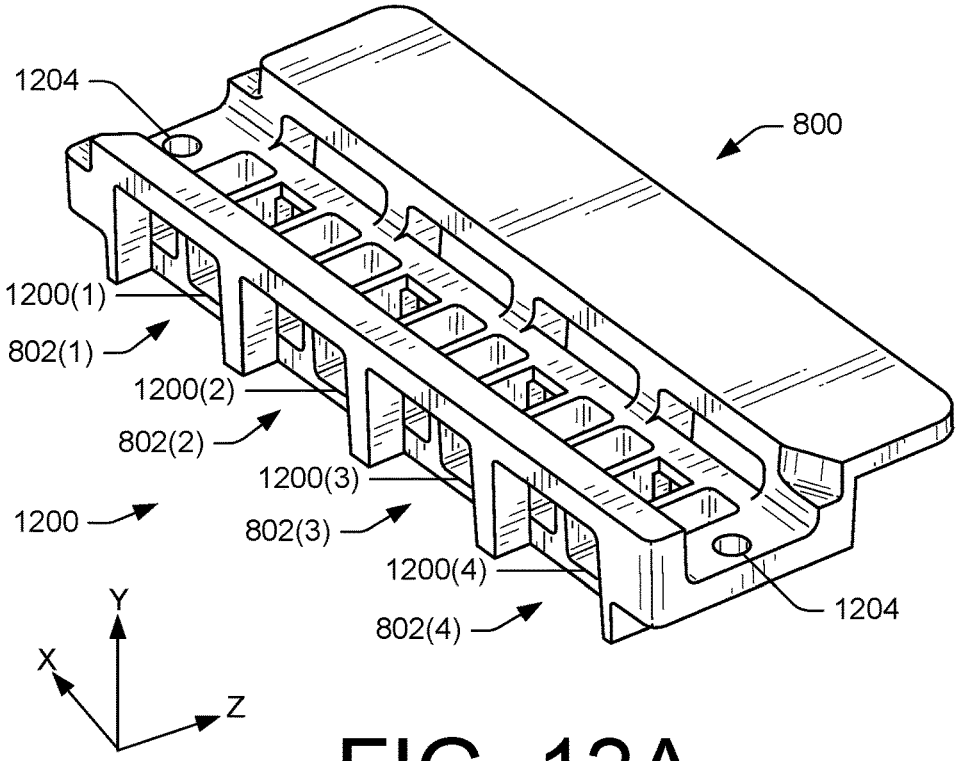
FIG. 12A illustrates a perspective view of the first side of the carriage of the locking mechanism with the second keys removed according to an embodiment in this disclosure.
Figure 12B:
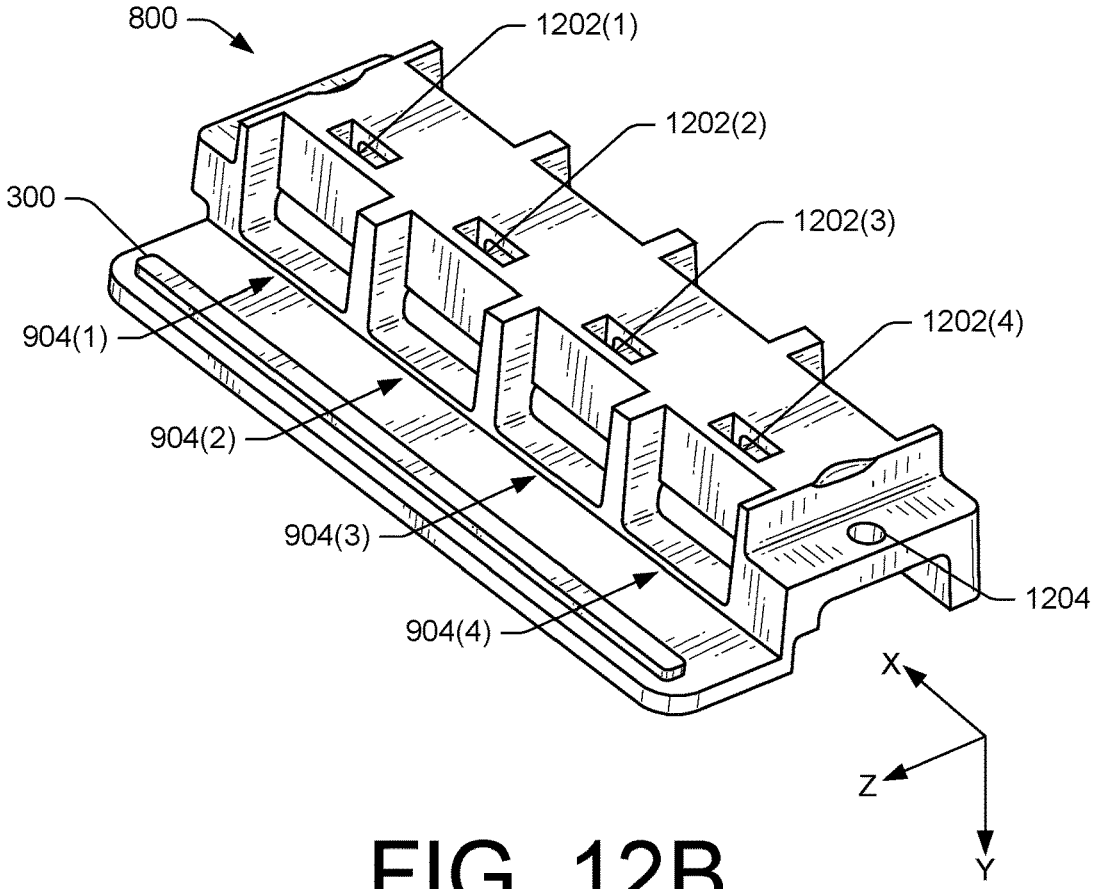
FIG. 12B illustrates a perspective view of the second side of the carriage of the locking mechanism with the second keys removed according to an embodiment in this disclosure.

FIGS. 12A and 12B illustrate a perspective view of a first side and a perspective view of a second side of the carriage 800, respectively. The carriage 800 may include the receivers 802 through which respective keys of the second keys 108 extend. Accordingly, the width (X-direction) of the receivers 802 may be sized to receive a width of the second keys 108.

The carriage 800 includes a first trough 1200(1), a second trough 1200(2), a third trough 1200(3), and a fourth trough 1200(4) (collectively, "troughs 1200"). The troughs 1200 may receive a respective spring of the springs 906. For example, the first trough 1200(1) may receive the first spring 906(1), the second trough 1200(2) may receive the second spring 906(2), the third trough 1200(3) may receive the third spring 906(3), and the fourth trough 1200(4) may receive the fourth spring 906(4). When assembled, a first end of the springs 906 may abut a surface (e.g., the surface 1012 or the surface 1112) of spring holder of the second keys 108 (e.g., the spring holder 1010 or the spring holder 1110) while a second end of the springs 906 may abut a surface of the carriage 800. The troughs 1200 may include an open end through which the springs 906 are inserted, and a back surface for receiving the second end of the springs 906. For example, the second end of the first spring 906(1) may abut a back surface 1202(1) of the first trough 1200(1). Accordingly, when the second keys 108 are actuated, the second end of the springs 906 may compress between the spring holder of the second keys 108 and the back ends 1202 of the troughs 1200.

The carriage 800 may further include one or more holes 1204 through which fasteners (not shown) are placed to couple the carriage 800 (and the locking mechanism 502) to the lid 102.

Figure 13:
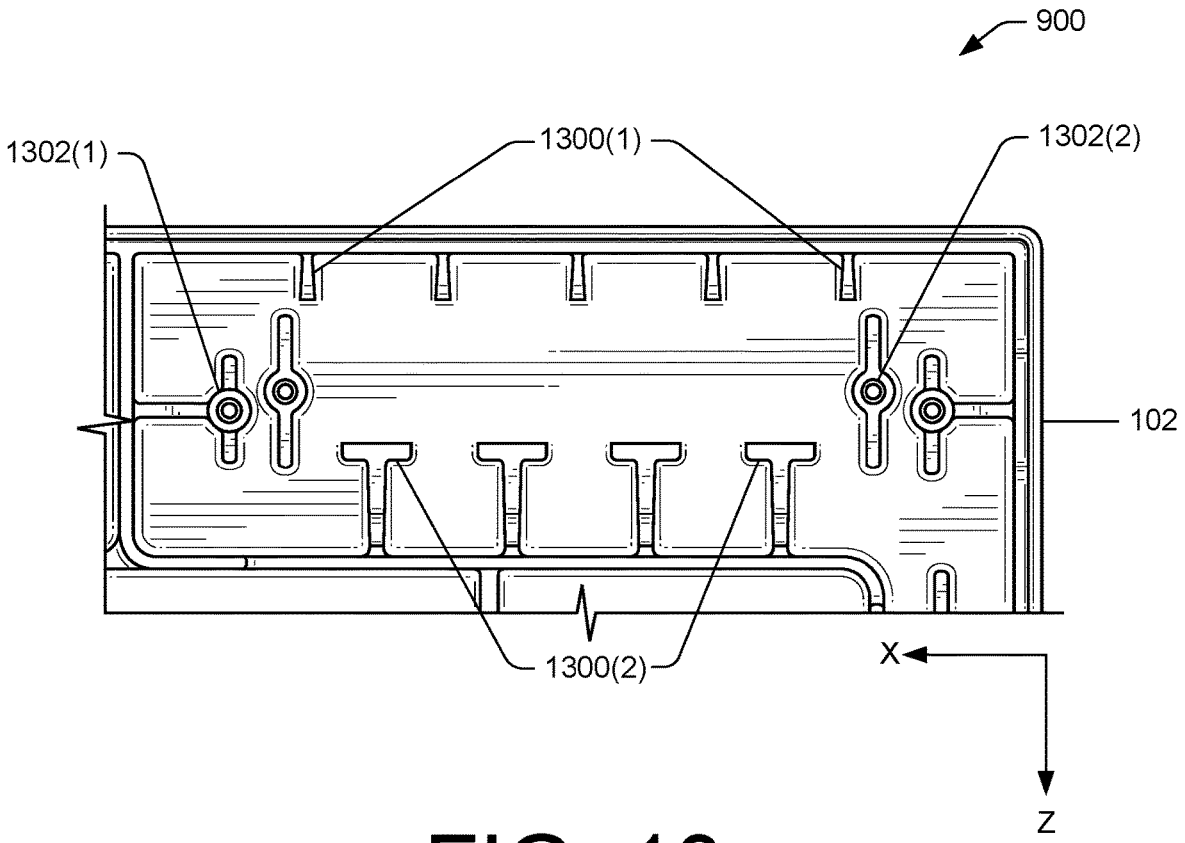
FIG. 13 illustrates a plane sectional view of the interior cavity of the lid of the storage container, showing the locking mechanism removed according to an embodiment in this disclosure.

FIG. 13 illustrates a plane sectional view of a portion of the interior of the lid 102. In an embodiment, the lid 102 may include one or more gussets 1300(1) and/or 1300(2) (e.g., ribs, flanges, supports, etc.) that align the carriage 800 within the lid 102. Additionally, the lid 102 may also include receptacles 1302(1) and/or 1302(2) to receive fasteners, such as a screw, that couple components (e.g., the first key 106 and/or the carriage 800) of the locking mechanism 502 to the lid 102.

Figure 14:
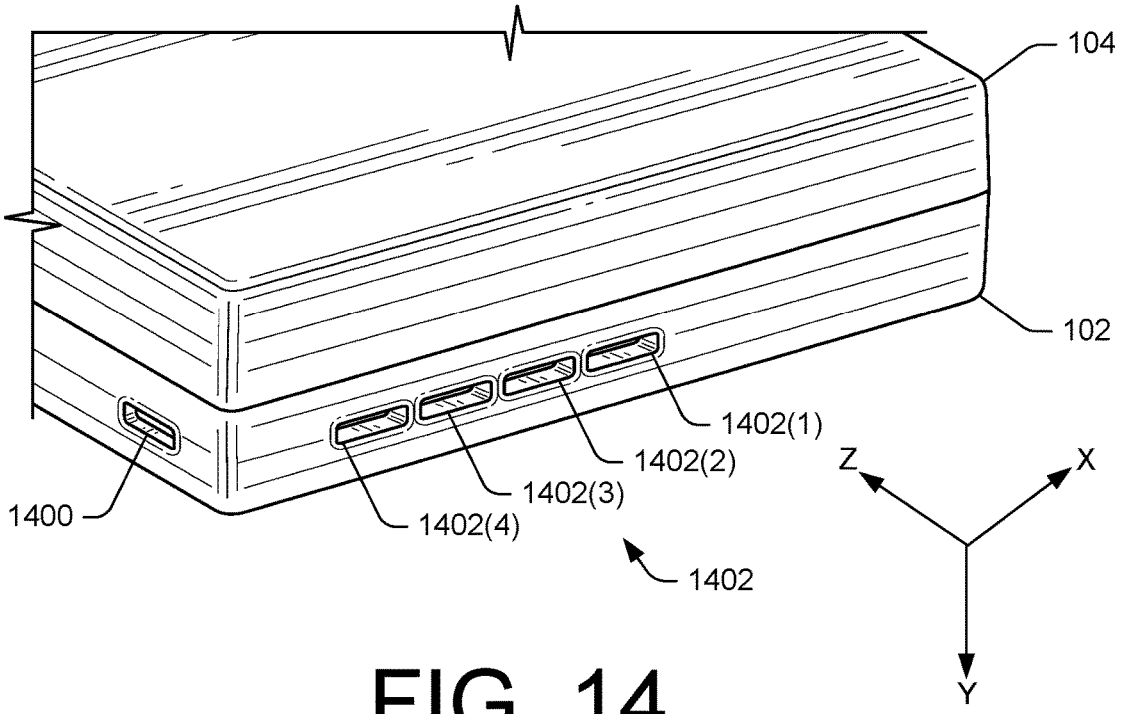
FIG. 14 illustrates a perspective view of an exterior of the storage container, showing the first key and the second keys removed according to an embodiment in this disclosure.

FIG. 14 illustrates a perspective view of an exterior of the storage container 100. FIG. 14 illustrates the storage container 100 without the locking mechanism 502 coupled thereto, indicated by the absence of the first key 106 and the second keys 108 protruding from the storage container 100). Shown in FIG. 14, the lid 102 may include holes through which the first key 106 and the second keys 108 extend, respectively. For example, the lid 102 may include a first hole 1400 through which a first end 704 of the first key 106 extends. The lid 102 may further include second holes 1402(1), 1402(2), 1402(3), and 1402(4) (collectively, "second holes 1402"). The second keys 108 may extend through a respective hole of the one or more second holes 1402 to be actuatable exterior to the storage container 100.

In an embodiment, to place the carriage 800 having the second keys 108 coupled thereto in the lid 102, the carriage 800 may be inserted into the lid 102 in the Z-direction (See FIG. 13) and then pushed downward in the Y-direction. Respective second keys 108 may be inserted through respective holes of the second holes 1402. As such, the first key 106 may extend through the first hole 1400.

Figure 15A:
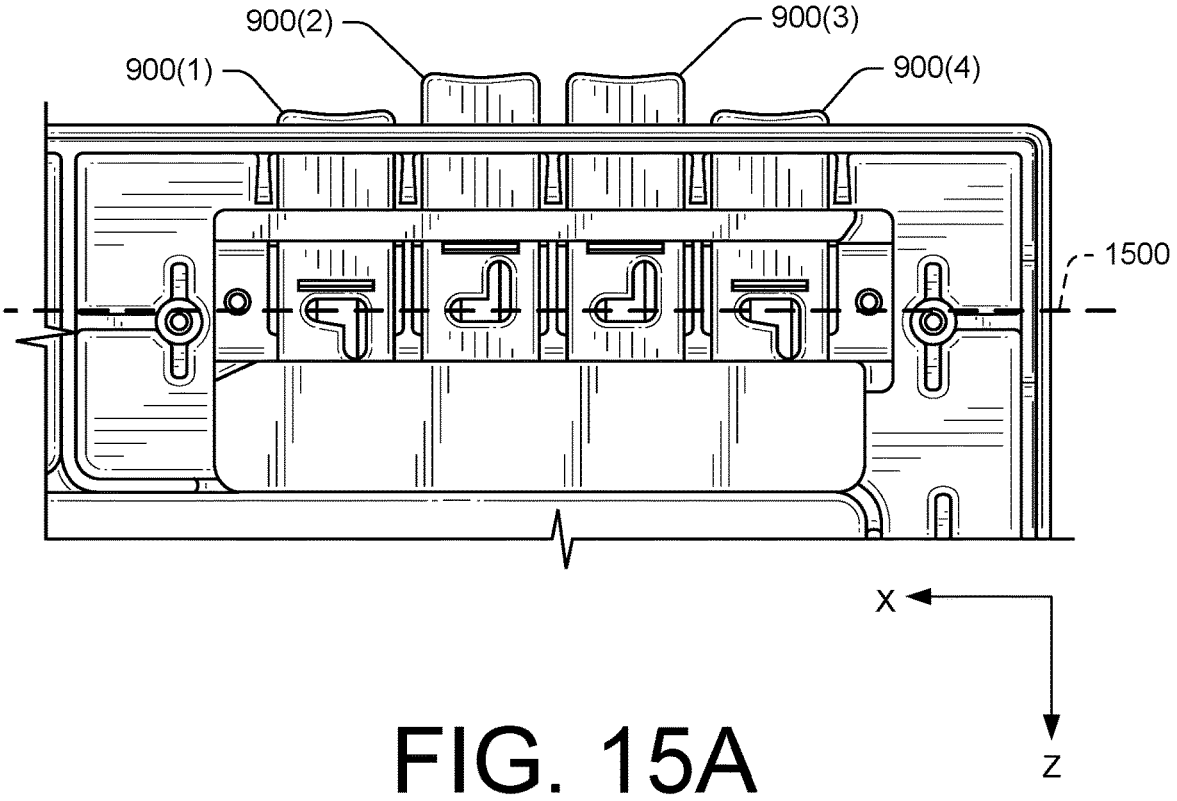
FIG. 15A illustrates a plane sectional view of the portion of the locking mechanism depicted in FIG. 6 with the first key removed and an example scenario of a correct combination of the second keys being pressed to unlock the storage container according to an embodiment in this disclosure.

FIG. 15A illustrates a plane sectional view of a portion of the locking mechanism 502. Notably, the first key 106 is not depicted in order to demonstrate the operation of the second keys 108. Specifically, FIG. 15A illustrates an embodiment where a correct combination of second keys 108 is actuated by a user. For example, the first key 900(1) is an unlocking key, the second key 900(2) is a locking key, the third key 900(3) is a locking key, and the fourth key 900(4) is an unlocking key. Additionally, shown in FIG. 15A, the first key 900(1) and the fourth key 900(4) are actuated, such that the first key 900(1) and the fourth key 900(4) are depressed from their respective resting positions, while the second key 900(2) and the third key 900(3) are not actuated.

From the illustration shown in FIG. 15A, the protrusions 714 on the first key 106 may be allowed to transition in the X-direction and along the line 1500. In other words, the first key 106 may be permitted to actuate in the X-direction and traverse the respective channels (e.g., the channel 1014 and the channel 1114) in the respective second keys 108 to unlock one or more locking points of the storage container 100. In an embodiment, to unlock the storage container 100, the first key 900(1) and the fourth key 900(4) may be actuated in a first direction (Z-direction), and thereafter, the first key 106 may be actuated in a second direction (X-direction).

In other words, as shown in FIG. 15A, the second keys 108 may be actuated such that the protrusions 714 slide, in the first direction, within the channels of the second keys 108. When the first key 106 is placed in communication with the second keys 108, the protrusions 714 may be disposed within a portion (e.g., the second portion 1014(2) or the second portion 1114(2)) of the second keys 108. As the correct combination of second keys 108 is actuated, the first key 106 may thereafter be actuated in the second direction that is different than the first direction, such that the protrusions 714 may reside within another portion of the channels (e.g., the first portion 1014(1) or the first portion 1114(1)) of the second keys 108. Accordingly, when the correct key combination is pressed, that is all unlocking keys 1000 (i.e., the first key 900(1) and the fourth key 900(4)) and no locking keys 1110 (i.e., the second key 900(2) and the third key 900(3)) are actuated, the protrusions 714 are capable of advancing in the second direction (X-direction).

Figure 15B:
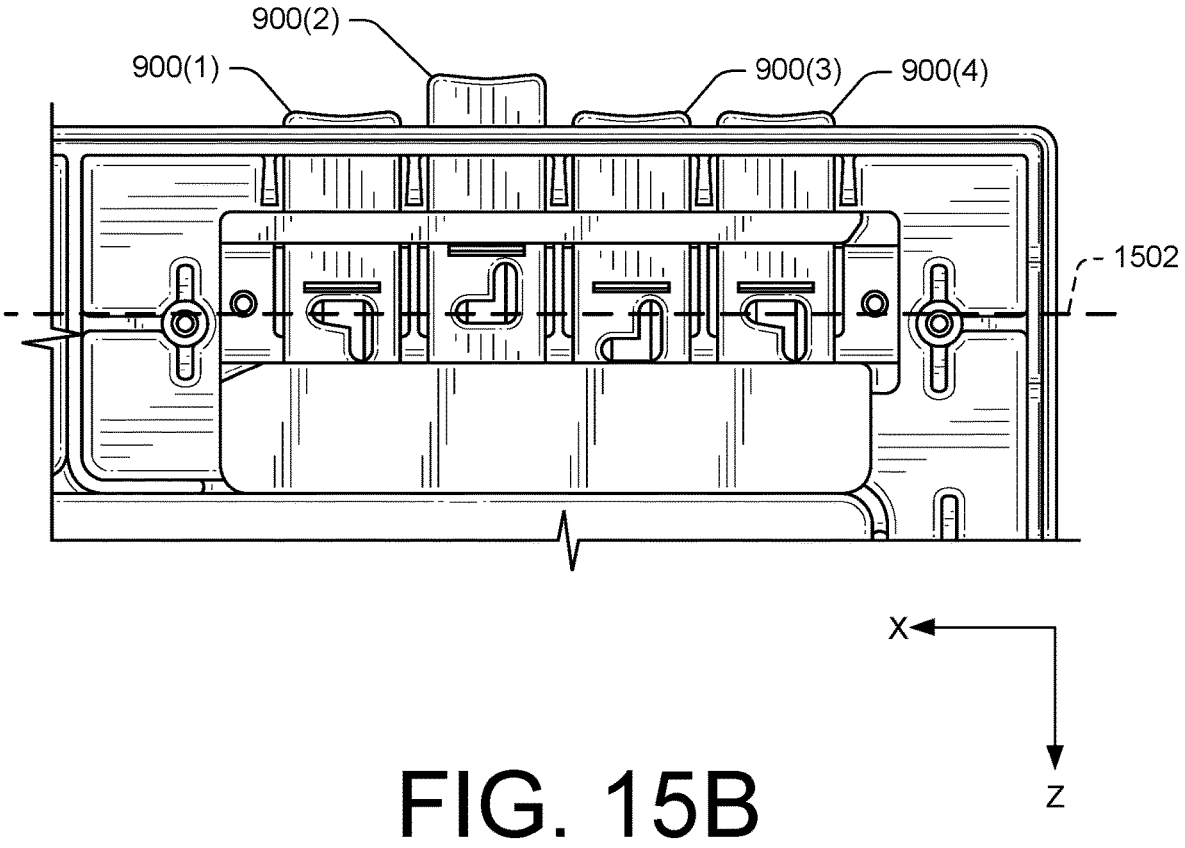
FIG. 15B illustrates a plane sectional view of the portion of the locking mechanism depicted in FIG. 6 with the first key removed and an example scenario of an incorrect combination of the keys being pressed to unlock the storage container according to an embodiment in this disclosure.

FIG. 15B illustrates a plane sectional view of a portion of the locking mechanism 502, showing the first key 106 removed to demonstrate an incorrect operation of the second keys 108. Specifically, FIG. 15B illustrates an embodiment where an incorrect combination of the second keys 108 (e.g., both the unlocking keys 1000 and the locking keys 1100) is actuated by a user. The embodiment shown in FIG. 15B illustrates the same order/configuration of second keys 108 as compared to the embodiment shown in FIG. 15A. However, compared to FIG. 15A, an incorrect combination of the second keys 108 is actuated by the user, thereby preventing the storage container 100 from opening. More particularly, FIG. 15B illustrates that the first key 900(1), the third key 900(3), and the fourth key 900(4) are actuated, while the second key 900(2) is not actuated. However, the third key 900(3) is not an unlocking key 1000, and hence, because it is actuated, the storage container 100 will not open. In other words, the protrusions 714 on the first key 106 may not be allowed to transition in the X-direction and along the line 1502. More particularly, because the third key 900(3) is actuated, the protrusion 714 engaging with the channel 1114 of the third key 900(3) may not be permitted to advance in the X-direction. That is, while the protrusion 714 engaged with the channel 1114 of the third key 900(3) may be actuated in the Z-direction, when a user attempts to actuate the first key 106 in the X-direction, the protrusion 714 may prevent the first key 106 from advancing in the X-direction (via abutting a sidewall of the channel 1114). Accordingly, in this situation, the storage container 100 may not be unlocked given that the first key 106 is not permitted to advance in the X-direction.

FIG. 15B further illustrates that even when the unlocking keys 1000 are actuated but a locking key 1000 is actuated, the first key 106 may be prevented from advancing and unlocking the storage container 100.

In an embodiment, the first key 106 may only be actuatable after the second keys 108 are actuated. That is, when no second keys 108 are actuated, the first key 106 may not be permitted to advance in the X-direction. However, when the correct combination of second keys 108 are actuated, such as the illustration in FIG. 15A, then the first key 106 may be actuated in the X-direction. Accordingly, in an embodiment, the order in which the first key 106 and/or the second keys 108 are actuated may unlock the storage container 100.

Furthermore, while a particular combination of second keys 108 is shown in FIGS. 15A and 15B, any combination of unlocking keys 1000 and locking keys 1100 may be included within the locking mechanism 502. However, it is to be understood that at least one unlocking key 1000 is included to allow access to the interior cavity 500. As such, a user of the storage container 100 may arrange the unlocking keys 1000 based on a particular combination of keys of second keys 108. For instance, a user may change the correct combination through manually exchanging the unlocking keys 1000 with the locking keys 1100. Users may therefore personalize the combination of the locking mechanism 502 and may taking into consideration personal grip, hand position, finger position, etc. Regardless of the arrangement or combination of the unlocking keys 800, when all the unlocking keys 100 are actuated and no locking keys 1100 are actuated, the storage container 100 may open.

Additionally, while a certain number of the first key 106 and/or the second keys 108 have been discussed, in an embodiment, a storage container according to this application may one or more first keys 106 and/or one or more second keys 108. Note, depending on the number of the first keys 106 and/or the second keys 108, the susceptibility of the storage container 100 being decoded or broken into may be affected.

Moreover, unlocking keys 1000 and locking keys 1100 that protrude from the storage container 100 may look the same (e.g., the first end 1002 and the first end 1102). Additionally, the level of resistance to actuation of each of the second keys 108 may vary or all may be the same. Such features of the storage container 100 may minimize any decoding feedback to an unauthorized user when an incorrect combination is actuated.

Figure 16:
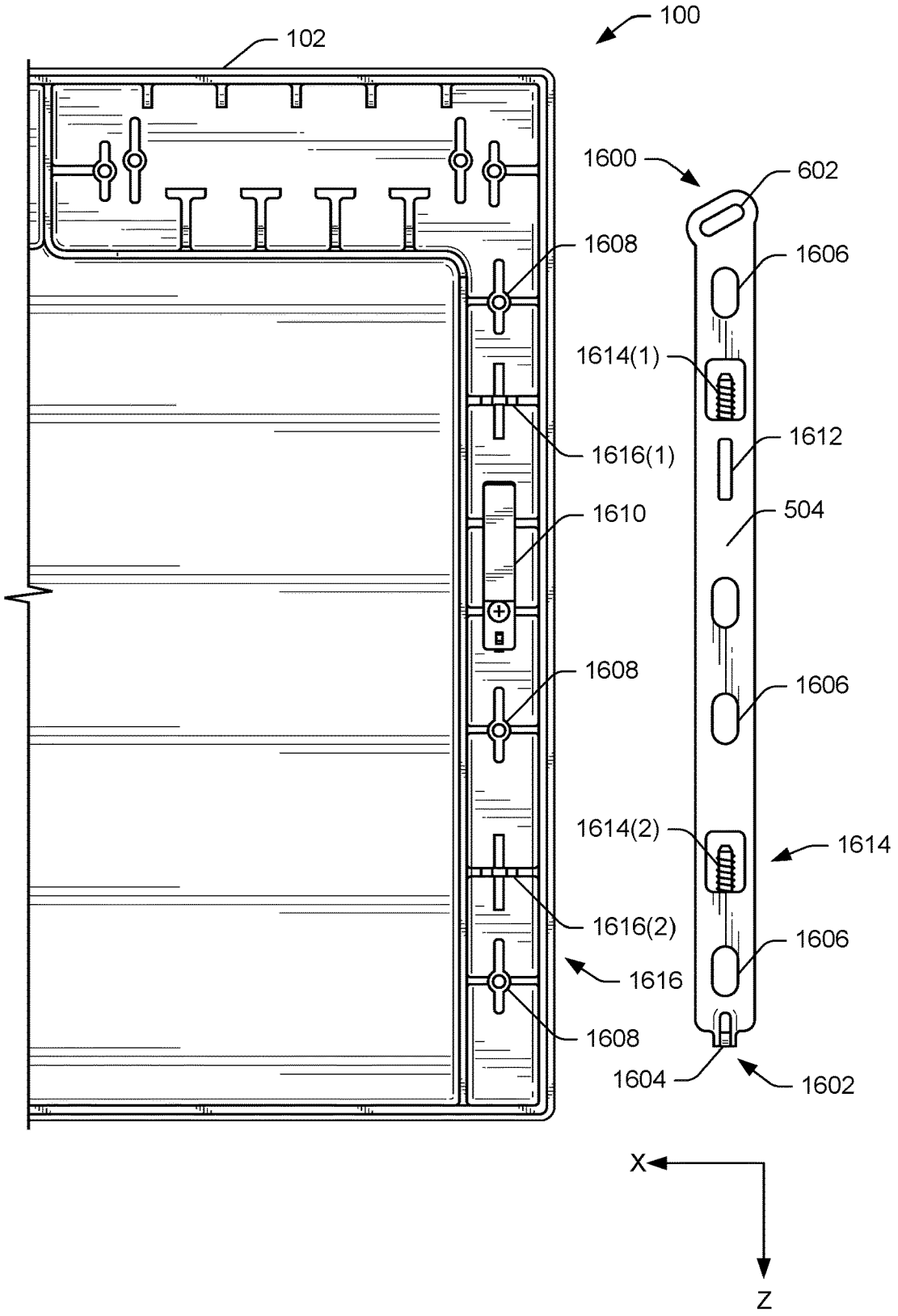
FIG. 16 illustrates a plane sectional view of the interior cavity of the lid of the storage container, showing a slide of the locking mechanism removed according to an embodiment in this disclosure.

FIG. 16 illustrates a plane sectional view of a portion of the lid 102, showing the slide 504 removed from the storage container 100 to demonstrate the operation of the slide 504. The slide 504 includes a first end 1600 and a second end 1602. At the first end 1600, the slot 602 may engage with the protrusion 600 located proximal to the first end 704 of the first key 106.

The second end 1602 of the slide 504 may include a second attachment mechanism 1604 having one or more features (e.g., latch, catch, flange, lip, protrusion, etc.) that engage with a corresponding attachment mechanism on the base 104 of the storage container 100 in the closed position. The engagement between the second attachment mechanism 1604 and the corresponding attachment mechanism on the base 104 may represent a second locking point of the locking mechanism 502 that unlocks the interior cavity 500. In an embodiment, the engagement between the second attachment mechanism 1604 with the base 104 may prevent an unauthorized user from pulling apart or prying apart portions of the storage container 100.

The slide 504 may include one or more slots 1606 through which fasteners (e.g., screws, snaps, pins, etc.) extend to couple the slide 504 to the lid 102. For instance, screws may extend through the one or more slots 1606 and engage with a respective receptacle 1608 on the lid 102. When fastened, the one or more slots 1606 allow the slide 504 to actuate in the Z-direction. The fasteners securing the slide 504 to the lid 102 may also align the slide 504 on the lid 102.

A tab 1610 may couple to the lid 102 and engage with an underneath side of the slide 504. When the locking mechanism 502 is unlocked, the tab 1610 may be configured to flex upward and thereby maintain the unlocked state of the locking mechanism 502 via interference such that a user does not have to continually actuate the combination of keys for the locking mechanism 502. In other words, when the locking mechanism 502 is unlocked, the slide 504 may extend in the Z-direction and an end of the tab 1610 may engage with a lip on the underneath side of the slide 504. This engagement may prevent the slide 504 from extending in the Z-direction. When unlocked, the first key 106, the second keys 108, and the slide 504 may remain in their actuated (e.g., depressed) state.

As illustrated and discussed below in FIG. 19, the base 104 may include a pin, which when transitioning to the closed state, comes into contact with the tab 1610 to deflect the tab 1610 in the Y-direction. By releasing the tab from the lip in the interference position, the slide 504 may advance in the Z-direction to lock the locking mechanism 502. More specifically, in the assembled position, the slide 504 is placed above the tab 1610 (in the Y-direction), and, upon closing the storage container 100, the pin may extend through an opening 1612 in the slide 504 in order to disengage the tab 1610 from the lip on the underneath side of the slide 504 that holds the locking mechanism 502 in the unlocked state, thereby permitting retraction of the slide 504 to the locked state.

To retract the locking mechanism 502, the slide 504 may include a first spring 1614(1) and a second spring 1614(2) (collectively, "springs 1614"). The springs 1614 may be positioned over rods on the slide 504, and when the pin on the base 104 deflects the tab 1610, the then compressed springs 1614 are from a compressed state to provide a force to retract the slide 504 to the locked state. As illustrated more clearly in FIGS. 17 and 18 herein, the first spring 1614(1) may abut a first barrier 1616(1) and the second spring 1614(1) may abut a second barrier 1616(2) (collectively, "barriers 1616") to provide resistance to the springs 1614 to a compressed state.

Figure 17:
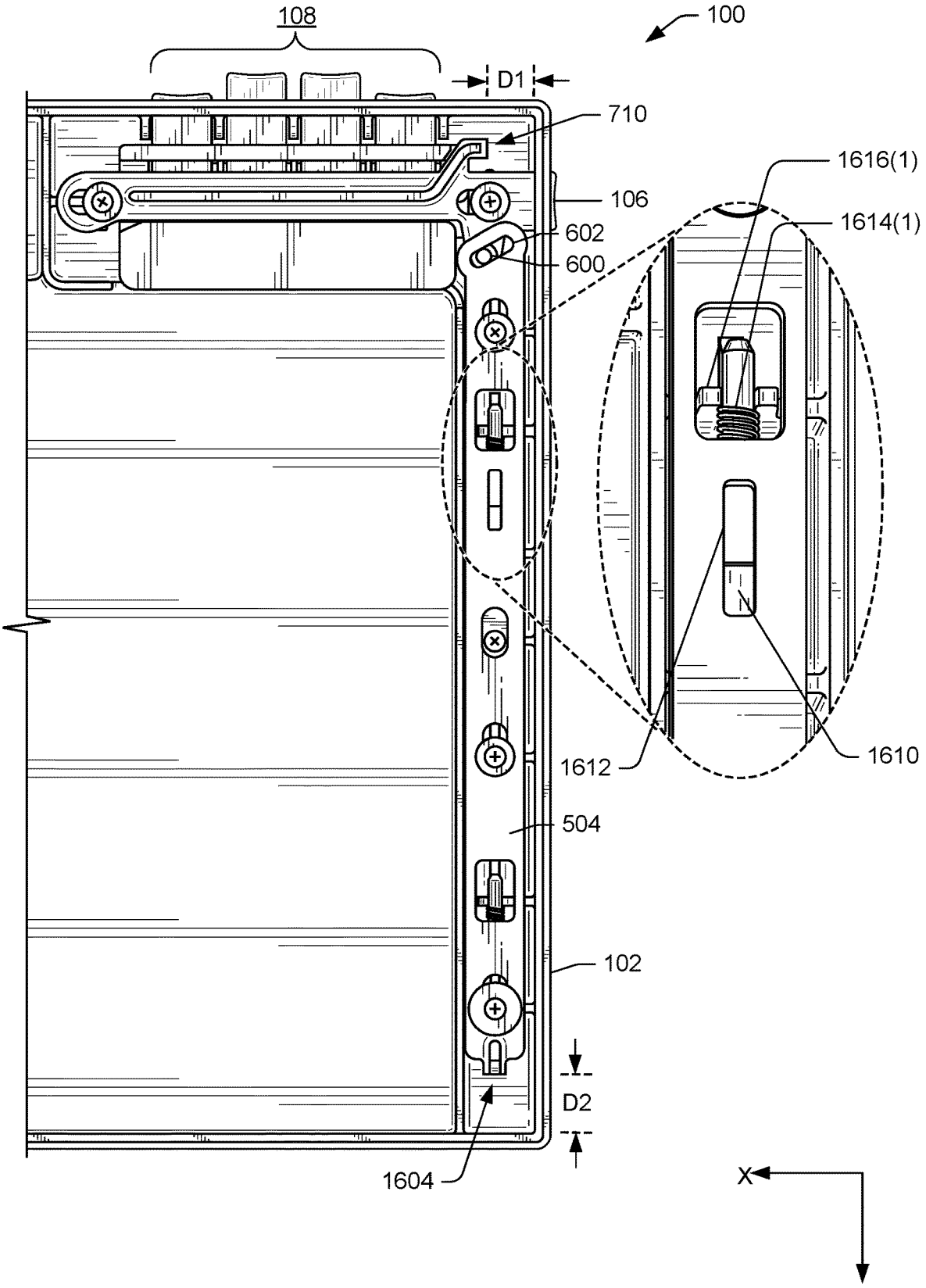
FIG. 17 illustrates a plane sectional view of the interior cavity of the lid of the storage container, showing the slide in the unlocked position according to an embodiment in this disclosure.

FIG. 17 illustrates a plane sectional view of the interior cavity 500 of the storage container 100, showing the locking mechanism 502 in the unlocked state and the slide 504 coupled to the lid 102. FIG. 17 illustrates a detailed view of an interaction between the slide 504 and the lid 102. More particularly, the detailed view in FIG. 17 illustrates the spring 1614(1) in a compressed state against the first barrier 1616(1).

The first key 106 and the second keys 108 of the locking mechanism 502 may be retained in the unlocked state through an interaction between the tab 1610 and the underneath side of the slide 504. That is, when engaged with the lip on the slide 504, the tab 1610 prevents the slide 504 from extending in the Z-direction. Moreover, because the first key 106 engages with the slide 504 (i.e., the slot 602 and the protrusion 600), the first key 106 may be prevented from shifting positions in the X-direction. In other words, the protrusion 600 may be locked within slot 602 and prevented from traversing the slot 602.

Moreover, the protrusions 714 on the first key 116 that are disposed within the channels (e.g., the channel 1014 or the channel 1114) in the second keys 108 prevent the second keys 108 from shifting position in the Z-direction. In the unlocked state, the protrusions 714 are disposed within a portion of the channels and abut a sidewall of the channels so as to prevent the second keys 108 from shifting in the Z-direction, as depicted in the channels shown in FIGS. 10A-10D, 11A-11D, and 15B.

As discussed above, the first attachment mechanism 710 on the first key 106 may engage with one or more attachment mechanisms on the base 104 in the locked state, and disengage with the one or more attachment mechanisms in the unlocked state. For example, FIG. 17 illustrates that a distance D1 exists between the first attachment mechanism 710 and a sidewall of the lid 102. The distance D1 may be such that, in the unlocked state, the first attachment mechanism 710 disengages with the one or more attachment mechanisms on the base 104 and allows the lid 102 to open. In an embodiment, the first attachment mechanism 710 may correspond to a first locking point of the locking mechanism 502.

Furthermore, the second attachment mechanism 1604 at the second end 1602 of the slide 504 may disengage with one or more additional attachment mechanisms on the base 104. That is, the second attachment mechanism 1604 may be separated by a distance D2 from the sidewall of the lid 102, which may disengage the second attachment mechanism 1604 with the corresponding attachment mechanism on the base 104. In an embodiment, the second attachment mechanism 1604 may correspond to a second locking point of the locking mechanism 502.

Figure 18:
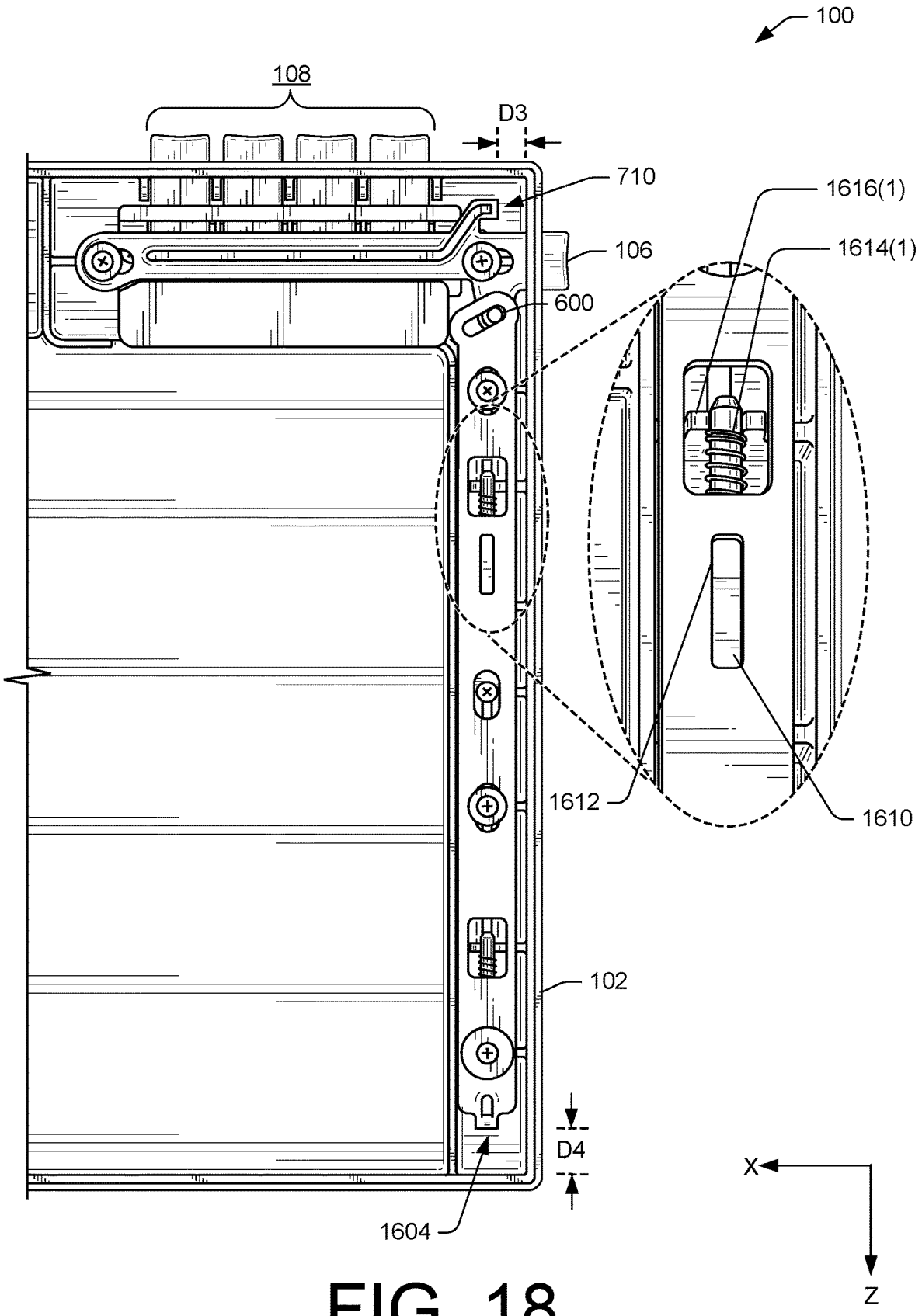
FIG. 18 illustrates a plane sectional view of the interior cavity of the lid of the storage container, showing the slide in the locked position according to an embodiment in this disclosure.

FIG. 18 illustrates a plane view of the interior cavity 500 of the storage container 100, showing the locking mechanism 502 in the locked state and the slide 504 coupled to the lid 102. FIG. 18 illustrates a detailed view of an interaction between the slide 504 and the lid 102. More particularly, the detailed view in FIG. 18 illustrates the spring 1614(1) in an uncompressed state against the first barrier 1616(1).

FIG. 18 further illustrates that the first key 106 and the second keys 108 of the locking mechanism 502 in the locked state and fully extending to their respective resting positions. Additionally, as the tab 1610 is no longer engaged with the lip on the underneath side of the slide 504, FIG. 18 illustrates that compared to FIG. 17, more of the tab 1610 is exposed within the slot 1612. That is, as the slide 504 is retracted in the Z-direction, a larger portion of the tab 1610 is shown within the slide 504.

Additionally, returning briefly to the channels 1014 of the unlocking keys 1000, the chamfer within the channel 1014 may assist in moving the protrusions 714 of the first key in the X-direction. That is, the slope created by the chamber may help assist in sliding the protrusions 714 in the X-direction whereby thereafter the second keys 108 may advance in the Z-direction via the protrusions 714 traversing the channels.

As shown in FIG. 18, and compared to FIG. 17, a distance D3 exists between the first attachment mechanism 710 and a sidewall of the lid 102. Here, the distance D3 may be less than D1 such that the first attachment mechanism 706 is closer to the sidewall of the lid 102. Accordingly, in the locked state, the first attachment mechanism 706 may engage with the corresponding attachment mechanism on the base 104 and lock the storage container 100.

Additionally, the second attachment mechanism 1604 may engage with one or more additional attachment mechanisms on the base 104. In the locked state, the second attachment mechanism 1604 may be separated by a distance D4 from the sidewall of the lid 102. The distance D4 may be less than the distance D2 such that the second attachment mechanism 1604 engages with the corresponding attachment mechanism on the base 104 in the locked state.

Figure 19:
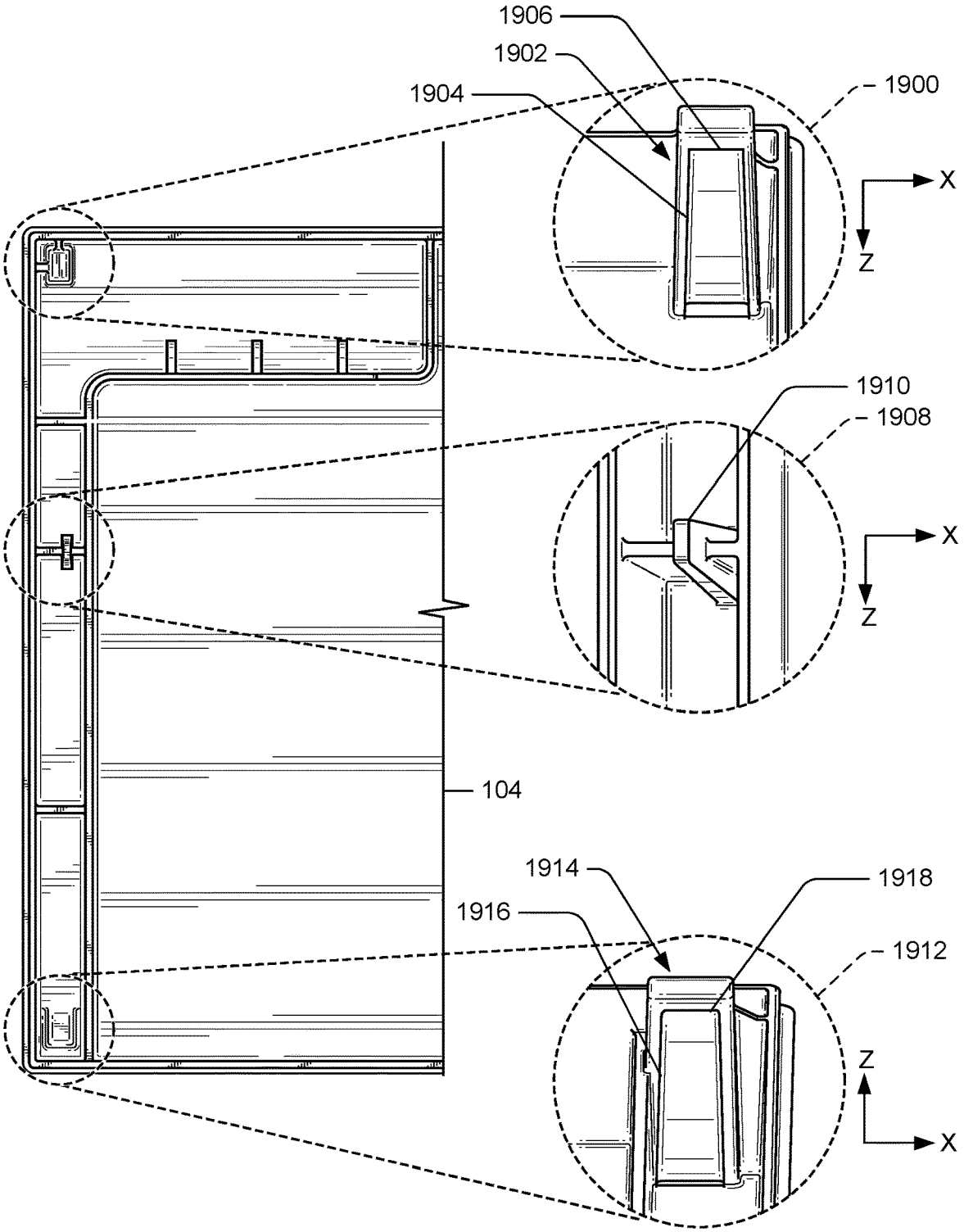
FIG. 19 illustrates a plane sectional view of the interior cavity of the base of the storage container, showing attachment mechanisms with which the first key and the slide engage and a latching mechanism component.

FIG. 19 illustrates a plane sectional view of the interior cavity 500, showing components of the base 104 and several detailed views of each of the of the attachment mechanisms of the base 104 as well as a pin that interacts with the tab 1610. Each of the detailed views are shown with reference to a respective Cartesian (X-Y-Z) coordinate systems.

Beginning with the detailed view 1900, a third attachment mechanism 1902 is shown. In an embodiment, the third attachment 1902 may include a receptacle having an opening 1904 and a lip 1906. The first attachment mechanism 710 (e.g., tab) may be sized to fit within the opening 1904 and engage with the lip 1906 in the locked state. In the unlocked state, the first attachment mechanism 710 may retract from the opening 1904 and disengage with the lip 1906, thereby allowing the storage container 100 to open.

Shown in detailed view 1908 may be a pin 1910 that is sized to fit through the slot 1612 and contact the tab 1610. Accordingly, the pin 1910 may be sized to deflect the tab 1610 such that the slide 504 may retract.

In a detailed view 1912, a fourth attachment mechanism 1914 is shown (which may be similar to the third attachment mechanism 1902). In an embodiment, the fourth attachment mechanism 1914 may include a receptacle having an opening 1916 and a lip 1918. The second attachment mechanism 1604 on the slide 504 may be sized to fit within the opening 1916 and engage with the lip 1918 in the locked state. In the unlocked state, the second attachment mechanism 1604 may retract from the opening 1916 and disengage with the lip 1918, thereby allowing the storage container 100 to open.

In an embodiment, to disengage the lid 102 and the base 104, and more particularly, the first attachment mechanism 710 from the third attachment mechanism 1902 and the second attachment mechanism 1604 from the fourth attachment mechanism 1914, downward pressure may be applied on the lid 102.

Figure 20:
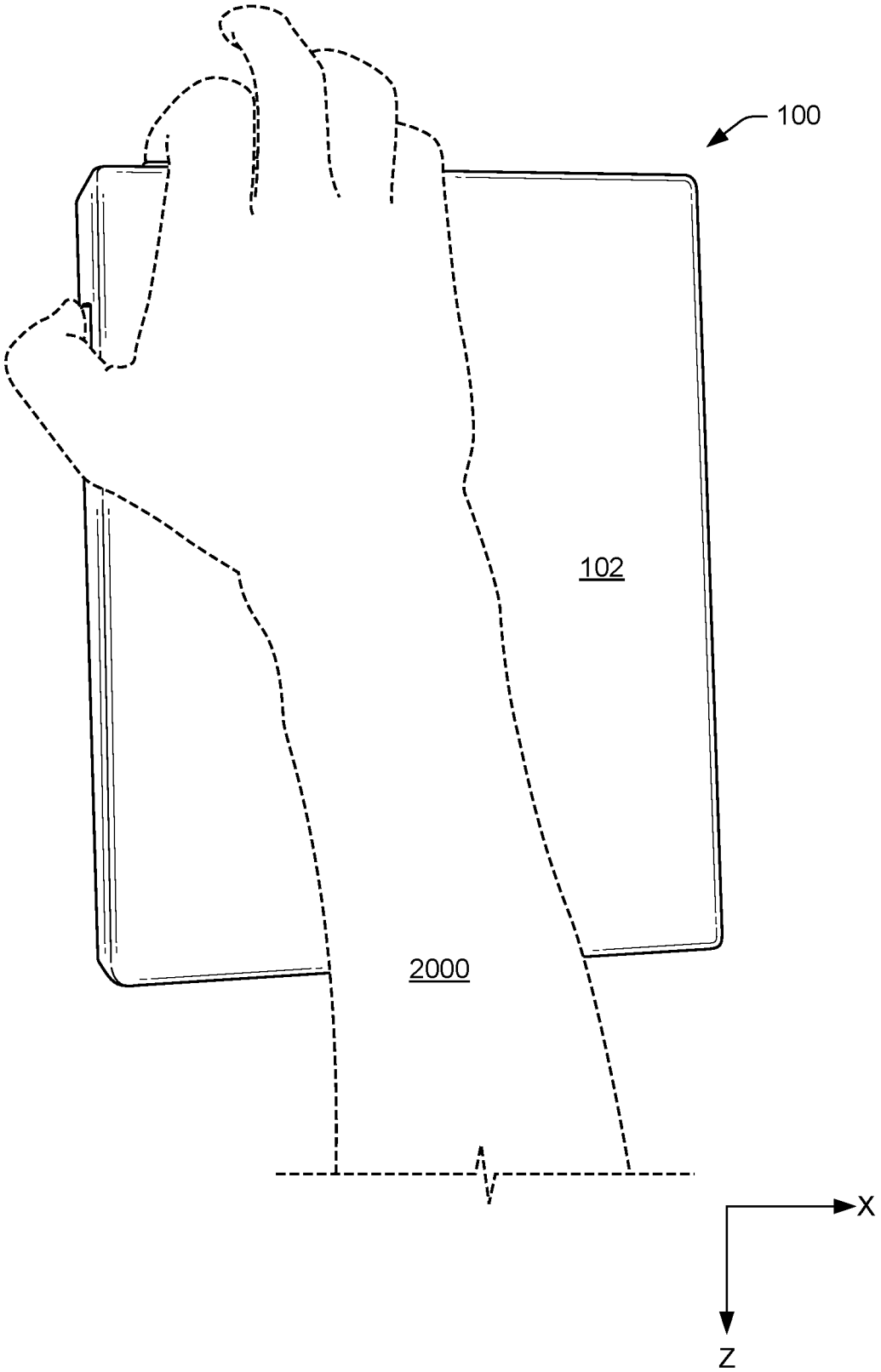
FIG. 20 illustrates an example of a user unlocking the storage container of FIG. 1 according to an embodiment in this disclosure.

FIG. 20 illustrates an arm 2000 of a user unlocking the storage container 100. For example, the storage container 100 may include the locking mechanism 502 having the combination of second keys 108 as shown in FIG. 18A (i.e., the first key 900(1) and the fourth key 900(4) may be unlocking keys 1000 to unlock the storage container 100). Shown in FIG. 20, the user may use his (or her) thumb to actuate the first key 106 in the X-direction and his index finger and pinky finger to actuate the respective second keys 108 in the Z-direction. In an embodiment, the user may press the second keys 108 first in the Z-direction, and thereafter, may press the first key 106 in the X-direction to unlock the locking mechanism 502.

While the foregoing invention is described with respect to the specific examples, it is to be understood that the scope of the invention is not limited to these specific examples. Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Although the application describes embodiments having specific structural features and/or methodological acts, it is to be understood that the claims are not necessarily limited to the specific features or acts described. Rather, the specific features and acts are merely illustrative some embodiments that fall within the scope of the claims of the application.

What is claimed is:

1. A storage container, comprising:

a lid including an exterior surface;

a base coupled to the lid;

an interior cavity defined by a closed state of the lid and the base; and a locking mechanism disposed in at least one of the lid or the base, the locking mechanism including:

a first key extending through the exterior surface and being actuatable in a first direction;

one or more second keys extending through the exterior surface and being actuatable in a second direction that is transverse to the first direction, the one or more second keys being configured to engage with the first key, wherein when the one or more second keys are actuated in the second direction, the first key is actuatable in the first direction to unlock the locking mechanism; and a slide operably engaged with the first key, the slide being actuatable in a third direction during actuation of the first key in the first direction, the third direction being different than the first direction.

2. The storage container of claim 1, wherein:

the locking mechanism further includes a first locking point and a second locking point, the first locking point is unlocked when the first key is actuated in the first direction, and the second locking point is unlocked when the slide is actuated in the third direction.

3. The storage container of claim 1, wherein the lid includes an interior surface, and the base includes an interior surface, and wherein the storage container further comprises:

foam coupled to at least a portion of the interior surface of the lid; and foam coupled to at least a portion of the interior surface of the base.

4. An apparatus comprising:

a housing; and a locking mechanism disposed in the housing and configured to transition the apparatus between a locked state and an unlocked state, the locking mechanism comprising:

a carriage defining a plurality of passageways, a first key coupled to the carriage being actuatable in a first direction to transition the apparatus from the locked state to the unlocked state, and a plurality of second keys disposed at least partially within individual passageways of the plurality of passageways, the plurality of second keys being operably coupled to the first key and actuatable within the individual passageways in a second direction that is transverse to the first direction, the plurality of second keys including:

at least one locking key that is engaged with the first key such that, when the at least one locking key is actuated, the first key is prohibited from actuating in the first direction, and at least one unlocking key that is engaged with the first key such that, when the at least one unlocking key is actuated, the first key is actuatable in the first direction.

5. The apparatus of claim 4, wherein:

the first key includes a first attachment mechanism, the apparatus further comprises a slide movably coupled to the first key and including a second attachment mechanism, the housing includes a third attachment mechanism and a fourth attachment mechanism, and the locking mechanism includes a first locking point and a second locking point, the first locking point being an engagement between the first attachment mechanism and the third attachment mechanism, and the second locking point being an engagement between the second attachment mechanism and the fourth attachment mechanism.

6. The apparatus of claim 4, wherein:

the at least one unlocking key includes a first channel, the at least one locking key includes a second channel that is different than the first channel, and the first key includes a plurality of protrusions, individual protrusions of the plurality of protrusions being configured to engage with one of the first channel or the second channel.

7. The apparatus of claim 5, wherein:

the slide includes a first end and a second end, the second attachment mechanism being disposed at the second end, and the slide operably couples to the first key at the first end.

8. The apparatus of claim 7, wherein:

the first end of the slide includes a slot, the first key includes a protrusion to engage with the slot on the slide, and when the first key is actuated in the first direction, the slide is actuated in a third direction that is different than the first direction and the second direction.

9. The apparatus of claim 4, wherein:

the housing includes a lid, and the first key and the plurality of second keys extend through an exterior surface of the lid.

10. The apparatus of claim 9, wherein:

the lid includes a first exterior side and a second exterior side that extends transversely to the first exterior side, the first key is disposed through the exterior surface on the first exterior side of the lid, and the plurality of second keys are disposed through the exterior surface on the second exterior side of the lid.

11. The apparatus of claim 5, wherein:

the first attachment mechanism includes a first tab, the second attachment mechanism includes a second tab, the third attachment mechanism includes a first receptacle and a first flange, the first tab being configured to fit through the first receptacle and engage the first flange in the locked state, and the fourth attachment mechanism includes a second receptacle and a second flange, the second tab being configured to fit through the second receptacle and engage the second flange in the locked state.

12. The apparatus of claim 5, wherein:

the slide further includes a latch, and the housing includes a tab that engages with the latch in the unlocked state, the engagement between the tab and the latch in the unlocked state being configured to maintain the first key, the plurality of second keys, and the slide in an actuated state.

13. The apparatus of claim 12, wherein:

the slide further includes a slot, the housing further includes a peg sized to fit through the slot, and when the apparatus is being closed, the peg engages with the tab to deflect the tab and disengage the tab from the latch.

14. The apparatus of claim 13, wherein:

the slide further includes a spring, and when the peg disengages the tab from the latch, the spring is positioned to actuate the slide in a third direction and transition the locking mechanism to the locked state.

15. An apparatus comprising:

a first housing;

a second housing coupled to the first housing via one or more hinges to form an enclosed cavity, the second housing including a first attachment mechanism; and a locking mechanism configured to transition the enclosed cavity between a locked state and an unlocked state, the locking mechanism including:

a first key, one or more second keys operably engaging with the first key, the one or more second keys including a first channel that, when the one or more second keys are actuated in a first direction, permit the first key to advance in a second direction, one or more third keys operably engaging with the first key, the one or more third keys including a second channel, and when at least one key of the one or more third keys is actuated in the first direction, the first key is restricted from advancing in the second direction, and a slide operably engaging with the first key, the slide including a second attachment mechanism that is engaged with the first attachment mechanism in the locked state and disengaged with the first attachment mechanism in the unlocked state.

16. The apparatus of claim 15, wherein:

the first key includes a plurality of protrusions, and individual protrusions of the plurality of protrusions engage with one of:

the first channel of individual keys of the one or more second keys, or the second channel of individual keys of the one or more third keys.

17. The apparatus of claim 15, wherein the first key includes a third attachment mechanism that is engaged with a fourth attachment mechanism on the second housing in the locked state, and disengaged with the fourth attachment mechanism in the unlocked state.

18. The apparatus of claim 15, wherein:

the first key protrudes through a first opening on a first side of the first housing, and the one or more second keys and the one or more third keys protrude through second openings, respectively, on a second side of the first housing.

19. The apparatus of claim 15, wherein:

the first housing includes foam lining on at least a portion of an interior surface thereof, and the second housing includes foam lining on at least a portion of an interior surface thereof.

* * * * *